US012558720B2

(12) United States Patent
Hanai et al.

(10) Patent No.: US 12,558,720 B2
(45) Date of Patent: Feb. 24, 2026

(54) FOUNDRY SAND RESERVING METHOD AND FOUNDRY SAND RESERVING SYSTEM

(71) Applicant: SINTOKOGIO, LTD., Nagoya (JP)

(72) Inventors: Takashi Hanai, Nagoya (JP); Yuichi Ogura, Nagoya (JP)

(73) Assignee: SINTOKOGIO, LTD., Nagoya (JP)

( * ) Notice: Subject to any disclaimer, the term of this patent is extended or adjusted under 35 U.S.C. 154(b) by 0 days.

(21) Appl. No.: 18/610,325

(22) Filed: Mar. 20, 2024

(65) Prior Publication Data

US 2024/0326118 A1 Oct. 3, 2024

(30) Foreign Application Priority Data

Mar. 31, 2023 (JP) ..... 2023-058003

(51) Int. Cl.
*B22C 5/14* (2006.01)

(52) U.S. Cl.
CPC ..... *B22C 5/14* (2013.01)

(58) Field of Classification Search
CPC ..... B22C 5/04; B22C 5/14
USPC ..... 164/456, 155.1
See application file for complete search history.

(56) References Cited

U.S. PATENT DOCUMENTS 5,816,312 A * 10/1998 Suginaka et al. ..... B22C 5/185 164/155.1
2019/0033241 A1* 1/2019 Aoki ..... G01N 27/043

FOREIGN PATENT DOCUMENTS

JP 2005-046863 A 2/2005

* cited by examiner

*Primary Examiner* — Kevin P Kerns
(74) *Attorney, Agent, or Firm* — Faegre Drinker Biddle & Reath LLP

(57) ABSTRACT

A foundry sand reserving method includes reserving, acquiring, setting, and controlling. The reserving includes reserving foundry sand capable of being supplied to a foundry sand related device in at least one reserving unit. The acquiring includes acquiring a reserve amount of the foundry sand in at least one reserving unit, a charge amount of the foundry sand to the reserving unit, and a supply amount of the foundry sand to a foundry sand related device. The setting includes setting a threshold for the reserve amount based on a predetermined aging time of the foundry sand and the charge amount and the supply amount acquired in the acquisition step. The controlling includes controlling at least one selected from the group consisting of the charge amount and the supply amount based on the reserve amount acquired in the acquiring step and the threshold set in the setting step.

20 Claims, 10 Drawing Sheets

FOUNDRY SAND RESERVING METHOD AND FOUNDRY SAND RESERVING SYSTEM

CROSS-REFERENCE TO RELATED APPLICATIONS

This application is based on and claims the benefit of priority from Japanese Patent Application No. 2023-058003 filed on Mar. 31, 2023, and the entire contents of which are incorporated herein by reference.

TECHNICAL FIELD

The present disclosure relates to a foundry sand reserving method and a foundry sand reserving system.

BACKGROUND

Japanese Unexamined Patent Publication No. 2005-046863 discloses a foundry sand recycling device. The foundry sand recycling device includes a ripening sand tank configured to ripen foundry sand while the foundry sand is received in a reservoir and discharged from a discharge port, and rotary drive means for rotating the ripening sand tank about a rotation center line. The foundry sand discharged from the discharge port is conveyed to a mold production unit by foundry sand conveyance means.

SUMMARY

Since it is necessary to adjust characteristics such as a temperature and a moisture content of the foundry sand before the foundry sand is supplied from a reserving unit such as a tank to a foundry sand related device, it is desirable that the foundry sand is reserved in the reserving unit for aging time (ripening time). However, a method for appropriately managing the aging time of the foundry sand has not been established. Even in a case where a timer or the like has been able to measure the aging time of the foundry sand reserved in the reserving unit, for example, in a case where the foundry sand is newly charged to the reserving unit after the measurement of the aging time is started, and in a case where the foundry sand is supplied from the reserving unit to the foundry sand related device, it is difficult to measure a time for each foundry sand. Thus, the aging time of the foundry sand may not be appropriately secured. Therefore, there is a demand for a foundry sand reserving method and a foundry sand reserving system capable of appropriately securing aging time of foundry sand.

A foundry sand reserving method according to the present disclosure includes reserving, acquiring, setting, and controlling. The reserving includes reserving foundry sand capable of being supplied to a foundry sand related device in at least one reserving unit. The acquiring includes acquiring a reserve amount of the foundry sand in at least one reserving unit, a charge amount of the foundry sand to the reserving unit, and a supply amount of the foundry sand to a foundry sand related device. The setting includes setting a threshold for the reserve amount based on a predetermined aging time of the foundry sand and the charge amount and the supply amount acquired in the acquisition step. The controlling includes controlling at least one selected from the group consisting of the charge amount and the supply amount based on the reserve amount acquired in the acquiring and the threshold set in the setting.

A foundry sand reserving system according to another aspect of the present disclosure includes at least one reserving unit and a control device. The at least one reserving unit reserves foundry sand capable of being supplied to a foundry sand related device. The control device controls at least one selected from the group consisting of a charge amount of the foundry sand to the reserving unit and a supply amount of the foundry sand to the foundry sand related device. The control device includes an acquisition unit, a setting unit, and a control unit. The acquisition unit acquires the reserve amount of the foundry sand in the at least one reserving unit, the charge amount, and the supply amount. The setting unit sets a threshold for the reserve amount based on a predetermined aging time of the foundry sand and the charge amount and the supply amount acquired by the acquisition unit. The control unit controls at least one selected from the group consisting of the charge amount and the supply amount based on the reserve amount acquired by the acquisition unit and the threshold.

According to the present disclosure, the aging time of the foundry sand can be appropriately secured.

DETAILED DESCRIPTION

Embodiments of Present Disclosure

Figure 1:
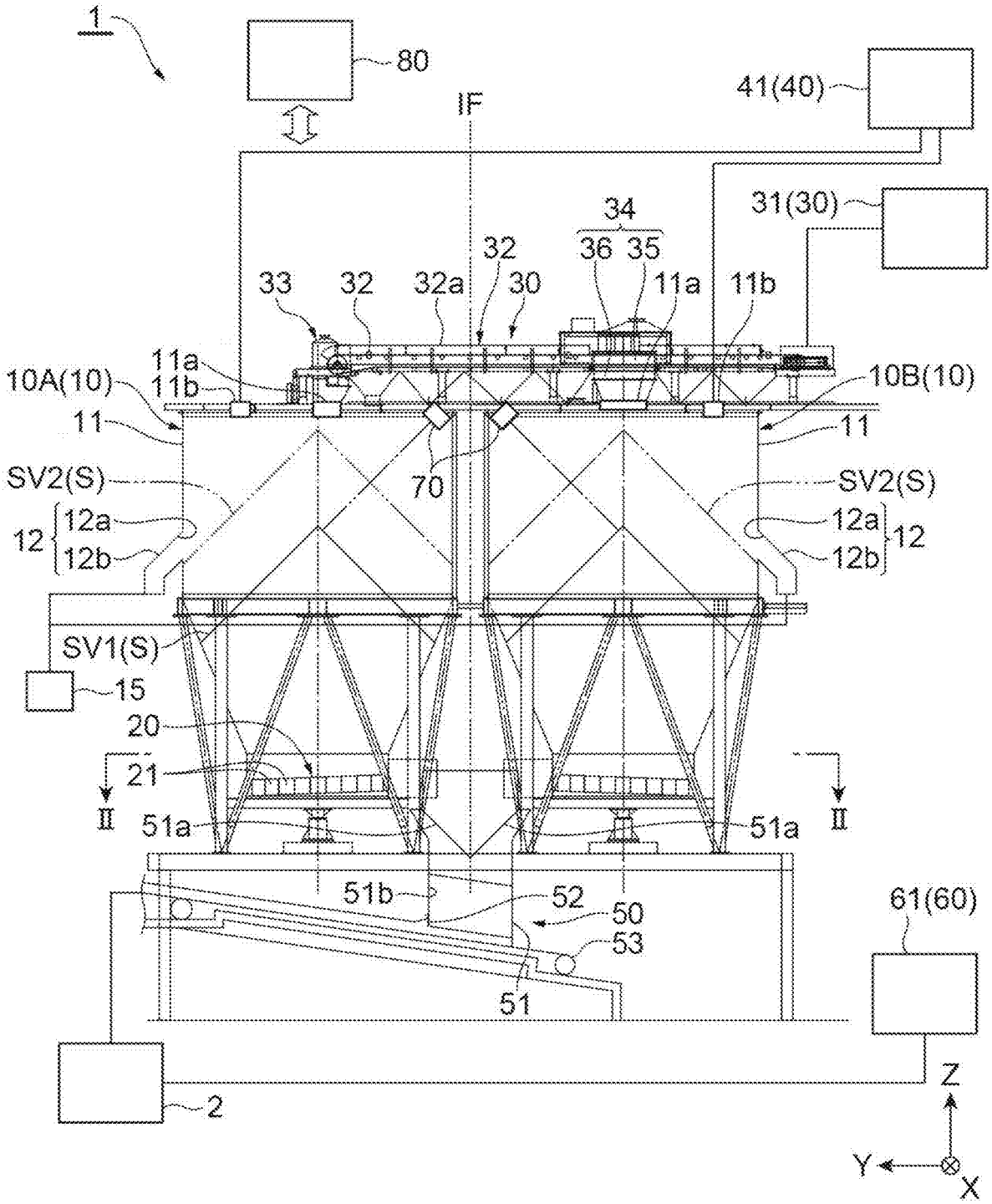
FIG. 1 is a diagram schematically illustrating a foundry sand reserving system according to an embodiment.

Hereinafter, embodiments of the present disclosure will be described with reference to the drawings. Note that, in the following description, the same or equivalent elements are denoted by the same reference signs, and redundant description will not be repeated. Dimensional ratios in the drawings do not necessarily coincide with those in the description. In the drawing, an X-axis direction and a Y-axis direction are horizontal directions, and a Z-axis direction is a vertical direction. The X-axis direction, the Y-axis direction, and the Z-axis direction are orthogonal to each other.

Outline of Foundry Sand Reserving System

FIG. 1 is a diagram schematically illustrating a foundry sand reserving system according to an embodiment. A foundry sand reserving system 1 illustrated in FIG. 1 reserves foundry sand S used in a foundry sand related device 2, and supplies the foundry sand S to the foundry sand related device 2. The foundry sand related device 2 includes, for example, a molding machine or a sand mixer. The foundry sand related device 2 may be other devices related to the foundry sand S. The foundry sand reserving system 1 reserves the foundry sand S such that a predetermined aging time is secured before the foundry sand S is supplied to the foundry sand related device 2. Laying includes remaining in a state of not being conveyed to the foundry sand related device 2 for a predetermined time. Laying includes adjusting a moisture content, a temperature, and the like of the foundry sand S to achieve a moisture content and a temperature required when the foundry sand S is used in the foundry sand related device 2.

The foundry sand reserving system 1 includes at least one reserving unit 10 and a control device 80. The foundry sand reserving system 1 further includes a preservation unit 15, a first charging unit 30, a second charging unit 40, an unloading unit 50, a supply unit 60, and at least one measuring instrument 70. In the foundry sand reserving system 1, the control device 80 sets a threshold based on the aging time of the foundry sand S, a charge amount of the foundry sand S charged to the at least one reserving unit 10, and a supply amount of the foundry sand S supplied to the foundry sand related device 2, and controls at least one selected from the group consisting of the charge amount and the supply amount based on the threshold and a reserve amount of the foundry sand S in the at least one reserving unit 10.

In the example illustrated in FIG. 1, the foundry sand reserving system 1 includes, as at least one reserving unit 10, a first reserving unit 10A and a second reserving unit 10B. The first reserving unit 10A and the second reserving unit 10B are provided along the Y-axis direction. The first reserving unit 10A is positioned in a positive direction of a Y-axis, and the second reserving unit 10B is positioned in a negative direction of the Y-axis. The first reserving unit 10A and the second reserving unit 10B have a symmetrical configuration with respect to an imaginary line IF extending in the vertical direction between the first reserving unit 10A and the second reserving unit 10B. Hereinafter, the first reserving unit 10A will be described as an example, but the second reserving unit 10B has a similar configuration.

The first reserving unit 10A includes a reserve container 11, a first discharge unit 12, and a second discharge unit 20. The reserve container 11 reserves the foundry sand S. In the example illustrated in FIG. 1, a deposit SV1 of foundry sand S having an inclined surface of a repose angle formed by the foundry sand S is reserved in the reserve container 11. The reserve container 11 is, for example, a sand bin. The reserve container 11 is a bottomed cylindrical member penetrating in the vertical direction. In top view, a lower end portion of the reserve container 11 is inclined such that a space in the reserve container 11 expands upward. An outer shape of an upper portion of the reserve container 11 is a cylindrical shape. An outer shape of a lower portion of the reserve container 11 is a truncated cone shape. The shape of the reserve container 11 is not limited.

First inlets 11*a* and second inlets 11*b* are formed at an upper end portion of the reserve container 11. The foundry sand S passes through the first inlets 11*a* and the second inlets 11*b*. The foundry sand S is supplied from the first charging unit 30 to the reserve container 11 through the first inlets 11*a*. In addition, the foundry sand S is supplied from the second charging unit 40 to the reserve container 11 through the second inlets 11*b*.

In a case where the reserve amount is larger than a predetermined upper limit, the first discharge unit 12 discharges the foundry sand S exceeding the upper limit from the first reserving unit 10A to the preservation unit 15. The first discharge unit 12 is provided on a side surface of an upper portion of the reserve container 11. A first discharge port 12*a* is formed in the side surface of the upper portion of the reserve container 11. The first discharge port 12*a* is provided at a predetermined position of the reserve container 11. The predetermined position is a position where a deposit SV2 of the foundry sand S having an inclined surface of a repose angle formed by the foundry sand S when an upper limit reserve amount of the foundry sand S is reserved in the reserve container 11 comes to contact with the side surface of the reserve container 11. The predetermined position may be higher or lower than the above-described position.

The first discharge unit 12 has a first discharge pipe 12*b* connected to the first discharge port 12*a*. The first discharge pipe 12*b* is a pipe line connected to the preservation unit 15. In a case where the reserve amount is larger than the upper limit, the foundry sand S exceeding the upper limit passes through the first discharge port 12*a* and the first discharge pipe 12*b* and is discharged to the preservation unit 15. The preservation unit 15 preserves the foundry sand S exceeding the upper limit in the reserve container 11. The preservation unit 15 is, for example, a hopper. The preservation unit 15 stores the foundry sand S discharged from the first discharge unit 12.

Figure 2:
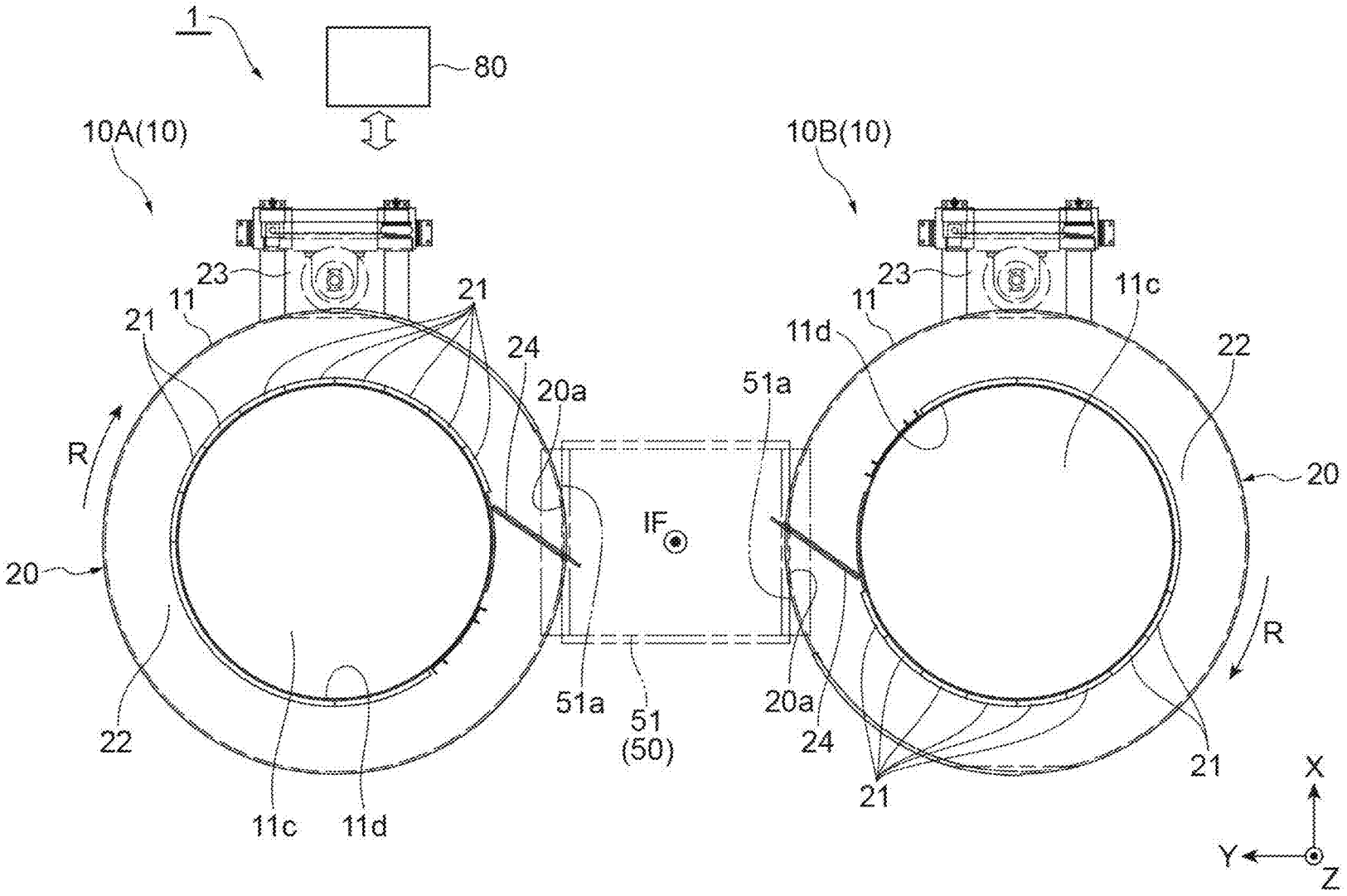
FIG. 2 is a schematic plan view illustrating an example of the foundry sand reserving system according to the embodiment indicated by line II-II in FIG. 1.

When the foundry sand S is supplied from the first reserving unit 10A to the foundry sand related device 2, the second discharge unit 20 discharges the foundry sand S from the reserve container 11. The second discharge unit 20 is provided at a bottom portion 11*c* of the reserve container 11. FIG. 2 is a schematic plan view illustrating an example of the foundry sand reserving system according to the embodiment indicated by line II-II in FIG. 1. A plurality of discharge gates 21, a rotary table 22, a drive unit 23, and a supply guide member 24 are provided in the second discharge unit 20 illustrated in FIG. 2. A second discharge port 20*a* for discharging the foundry sand S to a chute 51, to be described later, of the unloading unit 50 is provided in the second discharge unit 20.

The plurality of discharge gates 21 are provided on a circumference around a center of the bottom portion 11*c* of the reserve container 11. Each discharge gate 21 is a plate-shaped member having an arc shape in plan view. The plurality of discharge gates 21 of the first reserving unit 10A illustrated in FIG. 2 are provided in a positive direction of an X-axis from the center of the bottom portion 11*c* of the reserve container 11. Note that, the plurality of discharge gates 21 of the second reserving unit 10B illustrated in FIG. 2 are provided in a negative direction of the X-axis from the center of the bottom portion 11*c* of the reserve container 11. In the X-axis direction, an inner wall 11*d* of the reserve container is provided on an opposite side of the plurality of discharge gates 21 with respect to the center of the bottom portion 11*c* of the reserve container 11. Each discharge gate 21 is provided to be elevatable in the vertical direction with respect to the bottom portion 11*c*. When a lower end of each discharge gate 21 comes to contact with the bottom portion 11*c*, the foundry sand S is in a closed state not discharged to an outside.

The lower end of each discharge gate 21 is positioned at a position separated above the bottom portion 11*c*, and thus, an open state where an opening is formed is obtained. The foundry sand S in the reserve container 11 is discharged to the outside from the opening in the open state.

The rotary table 22 rotates in a state where the foundry sand S discharged from the plurality of discharge gates 21 is placed. The rotary table 22 is provided outside at least the plurality of discharge gates 21. The rotary table 22 constitutes, for example, a part of the bottom portion 11*c* of the reserve container 11. The rotary table 22 rotates, for example, clockwise (rotation direction R in FIG. 2).

The drive unit 23 controls elevation driving of the plurality of discharge gates 21 and rotational driving of the rotary table 22. The drive unit 23 is, for example, an electric actuator. Due to the driving of the drive unit 23, the plurality of discharge gates 21 are moved to positions in the open state or positions in the closed state. In addition, when at least the plurality of discharge gates 21 are positioned at the positions in the open state, the rotary table 22 is rotated in the rotation direction R by the driving of the drive unit 23.

The supply guide member 24 guides the foundry sand S on the rotary table 22 to the chute 51 to be described later of the unloading unit 50. The supply guide member 24 is, for example, a scraper. The supply guide member 24 extends in a direction intersecting the rotation direction R of the rotary table 22 and in the vertical direction. The supply guide member 24 comes to contact with the bottom portion 11*c* of the reserve container 11. The supply guide member 24 extends from a position adjacent to the discharge gate 21 closest to the second discharge port 20*a* among the plurality of discharge gates 21 toward an inlet 51*a* of the chute 51, to be described later, of the unloading unit 50.

Figure 3:
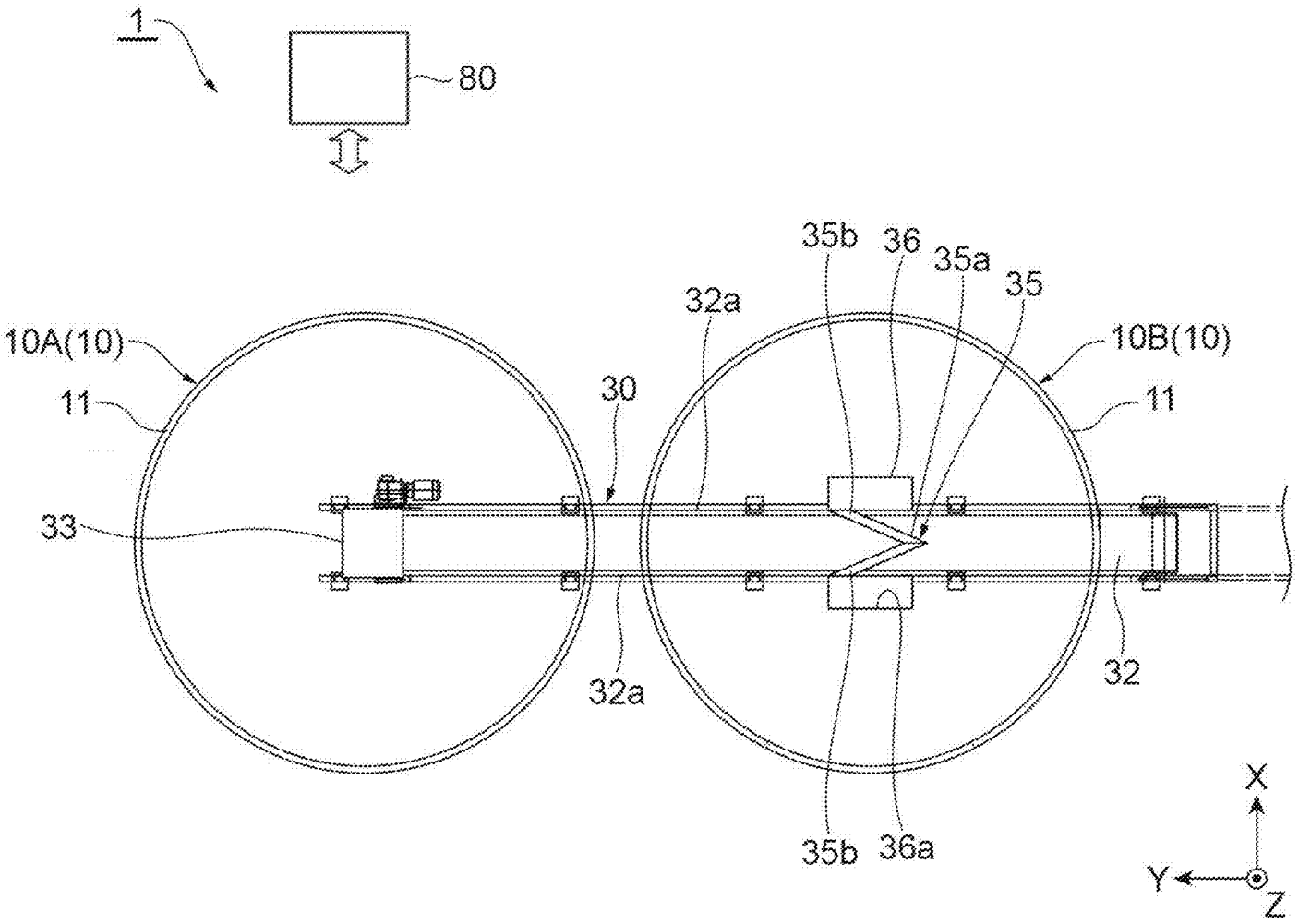
FIG. 3 is a schematic top view illustrating an example of the foundry sand reserving system according to the embodiment.

FIG. 3 is a schematic top view illustrating an example of the foundry sand reserving system according to the embodiment. As illustrated in FIG. 3, the first charging unit 30 is configured to charge the foundry sand S to each of the first reserving unit 10A and the second reserving unit 10B. The first charging unit 30 includes a first supply source 31, a charging path 32, a first charging guide unit 33, and a second charging guide unit 34. The first supply source 31 reserves the foundry sand S capable of being charged to each of the first reserving unit 10A and the second reserving unit 10B. The first supply source 31 is, for example, a hopper. The first supply source 31 adjusts an amount of the foundry sand S to be supplied by an opening degree of a gate (not illustrated).

The charging path 32 conveys from the first supply source 31 to the first inlets 11*a* of each of the first reserving unit 10A and the second reserving unit 10B. The charging path 32 conveys the foundry sand S in the positive direction of the Y-axis at a predetermined speed. Wall portions 32*a* extending upward (in a positive direction of a Z-axis) from the charging path 32 are provided at both end portions of the charging path 32, respectively, in the X-axis direction. The wall portions 32*a* and 32*a* suppress falling of the foundry sand S placed and conveyed in the charging path 32. The charging path 32 is, for example, a belt conveyor. The charging path 32 places the foundry sand S supplied from the first supply source 31, and conveys the foundry sand at a predetermined speed.

The first charging guide unit 33 guides the foundry sand S placed on a charging path 32 to the first inlets 11*a* of the first reserving unit 10A. The first charging guide unit 33 is provided, for example, immediately above the first reserving unit 10A and at a terminal portion of the charging path 32. The first charging guide unit 33 guides the foundry sand S conveyed in the positive direction of the Y-axis downward (in a negative direction of the Z-axis). For example, the first charging guide unit 33 guides all the foundry sand S conveyed to immediately above the first reserving unit 10A to the first reserving unit 10A.

The second charging guide unit 34 guides the foundry sand S placed on the charging path 32 to the first inlets 11*a* of the second reserving unit 10B. The second charging guide unit 34 is provided, for example, immediately above the second reserving unit 10B and at an intermediate portion of the charging path 32. The second charging guide unit 34 guides the foundry sand S conveyed in the positive direction of the Y-axis to the second reserving unit 10B therebelow. The second charging guide unit 34 includes a charging gate 35 and a chute 36. The charging gate 35 is provided above the charging path 32 in the Z-axis direction. The charging gate 35 is movable along the Z-axis direction and can be close to or separated from the charging path 32. The charging gate 35 extends in the vertical direction. The charging gate 35 has a V shape in top view. The charging gate 35 has a base end portion 35*a* and a pair of distal end portions 35*b*. The base end portion 35*a* is provided at a center of the charging path 32 in the X-axis direction. The base end portion 35*a* is provided in the negative direction of the Y-axis from the distal end portion 35*b*.

For example, the charging gate 35 moves up and down by driving of an actuator such as an air cylinder (not illustrated). When the charging gate 35 is in the open state, the charging gate 35 is provided above the charging path 32 in the Z-axis direction. The open state is a state where the foundry sand S on the charging path 32 is not charged to the second reserving unit 10B. The charging gate 35 can be close to the charging path 32 by moving downward. When the charging gate 35 is in the closed state, the charging gate 35 is provided at a position closest to the charging path 32 in the Z-axis direction. The closed state is a state where at least a part of the foundry sand S on the charging path 32 is guided to the second reserving unit 10B, and is a state where the charge amount of the foundry sand S to the first reserving unit 10A is reduced.

The chute 36 is a cylindrical member penetrating in the vertical direction. An opening portion 36*a* is formed at an upper end portion of the chute 36. In the X-axis direction, the opening portion 36*a* is longer than both ends of the charging path 32 and extends in the positive direction and the negative direction of the X-axis. In the Y-axis direction, the opening portion 36*a* has a length equal to or longer than the charging gate 35 and extends in the positive direction and the negative direction of the Y-axis. A lower end portion of the chute 36 is connected to an upper end portion of the second reserving unit 10B.

Referring back to FIG. 1, the description is continued. The second charging unit 40 is configured to charge the foundry sand S to each of the first reserving unit 10A and the second reserving unit 10B. When both a reserve amount in the first reserving unit 10A and a reserve amount in the second reserving unit 10B are smaller than a threshold, the second charging unit 40 charges the foundry sand S to the reserving unit in which the reserve amount is smaller than the threshold. The second charging unit 40 includes a second supply source 41. The second supply source 41 reserves the foundry sand S capable of being charged to each of the first reserving unit 10A and the second reserving unit 10B. The second supply source 41 is, for example, a hopper. The second supply source 41 adjusts an amount of the foundry sand S to be supplied by an opening degree of the gate (not illustrated). The second charging unit 40 conveys from the second supply source 41 to the second inlets 11*b* of each of the first reserving unit 10A and the second reserving unit 10B.

The unloading unit 50 will be described with reference to FIGS. 1 and 2. The unloading unit 50 receives the foundry sand S from the first reserving unit 10A and the second reserving unit 10B, conveys the foundry sand S to the foundry sand related device 2, and supplies the foundry sand S to the foundry sand related device 2.

The unloading unit 50 includes the chute 51, an unloading gate 52, and an unloading path 53. The chute 51 is a hollow member that collects the foundry sand S supplied by the rotary tables 22 and the supply guide members 24 of the first reserving unit 10A and the second reserving unit 10B. The chute 51 is provided between the first reserving unit 10A and the second reserving unit 10B. In the chute 51, for example, two inlets 51*a* and 51*a* and one outlet 51*b* are formed. The foundry sand S from each of the first reserving unit 10A and the second reserving unit 10B flows to each of the two inlets 51*a* and 51*a*. At the outlet 51*b*, the foundry sand S flowing to the chute 51 flows out toward the unloading path 53.

The unloading gate 52 is provided at the outlet 51*b* of the chute 51, and adjusts an opening degree of the outlet 51*b*. In a case where the unloading gate 52 is in the closed state, the supply of the foundry sand S from the chute 51 to the unloading path 53 is stopped. In a case where the unloading gate 52 is in the open state, the foundry sand S is supplied from the chute 51 to the unloading path 53.

The unloading path 53 conveys the foundry sand S supplied from the first reserving unit 10A and the second reserving unit 10B to the foundry sand related device 2. The unloading path 53 is, for example, a belt conveyor. In the example illustrated in FIG. 1, the unloading path 53 conveys the foundry sand S in the positive direction of the Y-axis. The unloading path 53 is provided, for example, below the first reserving unit 10A and the second reserving unit 10B.

The supply unit 60 illustrated in FIG. 1 is configured to supply the foundry sand S to the foundry sand related device 2. In a case where the supply amounts from the first reserving unit 10A and the second reserving unit 10B to the foundry sand related device 2 are smaller than a predetermined set amount, the supply unit 60 supplies the foundry sand S to the foundry sand related device 2. The supply unit 60 includes a third supply source 61. The third supply source 61 reserves the foundry sand S capable of being supplied to the foundry sand related device 2. The foundry sand S includes foundry sand S supplied from the first reserving unit 10A and the second reserving unit 10B in the past. The foundry sand S includes foundry sand S for which an appropriate aging time is secured. The third supply source 61 is, for example, a hopper. The third supply source 61 adjusts an amount of the foundry sand S to be supplied by an opening degree of the gate (not illustrated). The supply unit 60 conveys the foundry sand to the foundry sand related device 2 from the third supply source 61.

The foundry sand reserving system 1 includes two measuring instruments 70 and 70 as at least one measuring instrument 70. The two measuring instruments 70 and 70 measure the reserve amounts in the first reserving unit 10A and the second reserving unit 10B. Each measuring instrument 70 includes at least one selected from the group consisting of a microwave sensor, a millimeter wave sensor, and a sounding level gauge. Each measuring instrument 70 of the present embodiment is a microwave sensor. Each measuring instrument 70 is provided at a position capable of applying microwave, in a direction intersecting the inclined surface of the deposit SV1 of the foundry sand S formed in each of the first reserving unit 10A and the second reserving unit 10B. The repose angle is an angle formed between a horizontal plane and the inclined surface of the deposit SV1 formed when the foundry sand S charged to the reserve container 11 is kept stable without spontaneously collapsing. Each measuring instrument 70 is provided, for example, at a position capable of applying microwave in the direction intersecting the inclined surface of the deposit SV1 of the foundry sand S formed in each of the first reserving unit 10A and the second reserving unit 10B. The direction intersecting the inclined surface may be, for example, at a substantially right angle with respect to the inclined surface.

Each measuring instrument 70 applies microwave to the deposit SV1, and receives the microwave reflected by the deposit SV1. Each measuring instrument 70 measures the reserve amount of the foundry sand S (a size of the deposit SV1) in the reserve container 11 by measuring a time from the application to the reception of the microwave, an incident angle at the time of reception of the reflected microwave, and the like. Each measuring instrument 70 outputs the measured reserve amount of the foundry sand S to the control device 80.

The control device 80 controls the entire foundry sand reserving system 1. The control device 80 includes, for example, a programmable logic controller (PLC). The control device 80 may be a normal computer system including a main storage device such as a central processing unit (CPU), a random access memory (RAM), and a read only memory (ROM), an input device such as a touch panel and a keyboard, an output device such as a display, an auxiliary storage device such as a hard disk, and the like.

For example, an operation panel operable by an operator is provided in the control device 80. The control device 80 is connected to be able to communicate with the second charging unit 40, the unloading unit 50, the supply unit 60, and the two measuring instruments 70 and 70. The control device 80 outputs control signals to the second charging unit 40, the unloading unit 50, the supply unit 60, and the two measuring instruments 70 and 70 to control operations of these components. The control device 80 reads a program prepared in advance, and operates the second charging unit 40, the unloading unit 50, the supply unit 60, and the two measuring instruments 70 and 70. The control device 80 may operate the second charging unit 40, the unloading unit 50, the supply unit 60, and the two measuring instruments 70 and 70 in accordance with a command operation of the worker received by an operation unit (not illustrated).

Figure 4:
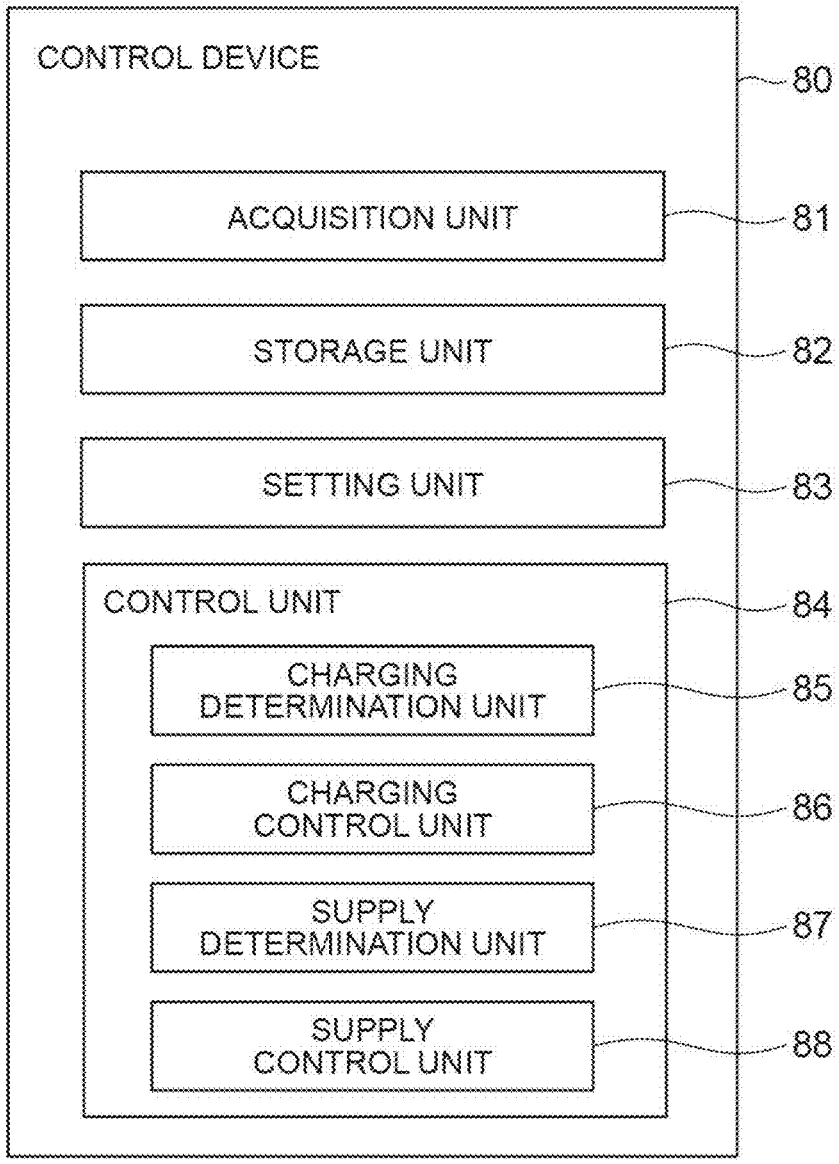
FIG. 4 is a block diagram illustrating an example of a control device of the foundry sand reserving system according to the embodiment.

FIG. 4 is a block diagram illustrating an example of the control device of the foundry sand reserving system 1 according to the embodiment. As illustrated in FIG. 4, the control device 80 includes an acquisition unit 81, a setting unit 83, and a control unit 84. The control device 80 further includes a storage unit 82.

The acquisition unit 81 acquires the reserve amounts of the foundry sand S in the first reserving unit 10A and the second reserving unit 10B, the charge amounts of the foundry sand S to the first reserving unit 10A and the second reserving unit 10B, and the supply amounts of the foundry sand S from the first reserving unit 10A and the second reserving unit 10B to the foundry sand related device 2. The acquisition unit 81 acquires the reserve amounts of the foundry sand S in the first reserving unit 10A and the second reserving unit 10B measured from the two measuring instruments 70 and 70. The acquisition unit 81 acquires, from the storage unit 82, charge amounts and supply amounts set at a point in time when the reserve amounts of the foundry sand S in the first reserving unit 10A and the second reserving unit 10B are measured by the two measuring instruments 70 and 70.

The storage unit 82 stores the reserve amounts of the foundry sand S in the first reserving unit 10A and the second reserving unit 10B acquired by the acquisition unit 81. The storage unit 82 stores a predetermined aging time for the foundry sand S. The storage unit 82 stores a predetermined set value for each supply amount from the first reserving unit 10A and the second reserving unit 10B to the foundry sand related device 2. The aging time and the set value are set by, for example, the worker or the like in accordance with a type, a temperature, and a moisture content of the foundry sand S, and the use of the foundry sand S in the foundry sand related device 2. The storage unit 82 stores values set by the setting unit 83 and the control unit 84. The storage unit 82 stores, for example, a program for operating each component. The storage unit 82 stores charge amounts and supply amounts set by a charging control unit 86 and a supply control unit 88 to be described later.

The setting unit 83 sets a threshold for the reserve amounts based on the predetermined aging time of the foundry sand S and the charge amounts and the supply amounts acquired by the acquisition unit 81. The threshold is, for example, a value determined to be reserved in the reserve container 11 by an amount equal to or larger than the supply amount supplied to the foundry sand related device 2 during aging time of newly charged foundry sand S.

The control unit 84 controls at least one selected from the group consisting of the charge amounts and the supply amounts based on the reserve amounts of the foundry sand S in the first reserving unit 10A and the second reserving unit 10B acquired by the acquisition unit 81 and the threshold set by the setting unit 83. The control unit 84 includes a charging determination unit 85, the charging control unit 86, a supply determination unit 87, and the supply control unit 88.

The charging determination unit 85 determines whether or not each of the reserve amounts in the first reserving unit 10A and the second reserving unit 10B is smaller than the threshold. In addition, the charging determination unit 85 determines whether or not the reserve amount in a certain reserving unit 10 is smaller than the reserve amount in another reserving unit 10.

The charging control unit 86 controls the charge amounts to the first reserving unit 10A and the second reserving unit 10B. For example, the charging control unit 86 controls the charge amounts of the foundry sand S in at least one selected from the group consisting of the first charging unit 30 and the second charging unit 40. The charging control unit 86 stores, in the storage unit 82, the controlled charge amounts to the first reserving unit 10A and the second reserving unit 10B. The charging control unit 86 controls the opening degree of the charging gate 35 in the second charging guide unit 34 with respect to the first charging unit 30. The charging control unit 86 controls the opening degree of the gate for adjusting the amount of the foundry sand S, a conveyance speed to each of the first reserving unit 10A and the second reserving unit 10B, and the like with respect to the second charging unit 40.

The charging control unit 86 calculates the charge amounts based on the control contents described above. The charge amount includes the charge amount by the first charging unit 30 and the charge amount by the second charging unit 40. The charge amount by the first charging unit 30 is calculated based on, for example, the opening degree of the gate in the first supply source 31, the conveyance speed of the foundry sand S in the charging path 32, and the opening degree of the charging gate 35. The charge amount by the second charging unit 40 is calculated based on the opening degree of the gate in the second supply source 41 and the conveyance speed of the foundry sand S.

The supply determination unit 87 determines whether or not the supply amounts from the first reserving unit 10A and the second reserving unit 10B to the foundry sand related device 2 are smaller than the threshold. In addition, the supply determination unit 87 determines whether or not the reserve amount in a certain reserving unit 10 is smaller than the reserve amount in another reserving unit 10.

The supply control unit 88 controls the supply amounts from the first reserving unit 10A and the second reserving unit 10B to the foundry sand related device 2. For example, the supply control unit 88 controls each supply amount of the foundry sand S in at least one selected from the group consisting of the second discharge unit 20 and the supply unit 60. The supply control unit 88 stores the controlled supply amounts in the storage unit 82. Specifically, the supply control unit 88 controls an opening degree of an opening formed by each discharge gate 21 and the bottom portion 11*c*, a rotation speed of the rotary table 22, and the like with respect to the second discharge unit 20. The supply control unit 88 controls, for the supply unit 60, the opening degree of the gate for adjusting the amount of the foundry sand S, the conveyance speed to the foundry sand related device 2, and the like.

The supply control unit 88 calculates each supply amount based on the control content described above. The supply amount includes the supply amounts from the first reserving unit 10A and the second reserving unit 10B to the foundry sand related device 2 and the supply amount from the supply unit 60 to the foundry sand related device 2. The supply amount from the first reserving unit 10A (second reserving unit 10B) to the foundry sand related device 2 is calculated based on, for example, the opening degree of each discharge gate 21 and the rotation speed of the rotary table 22. The charge amount by the supply unit 60 is calculated based on the opening degree of the gate in the third supply source 61 and the conveyance speed of the foundry sand S.

Foundry Sand Reserving Method

Figure 5:
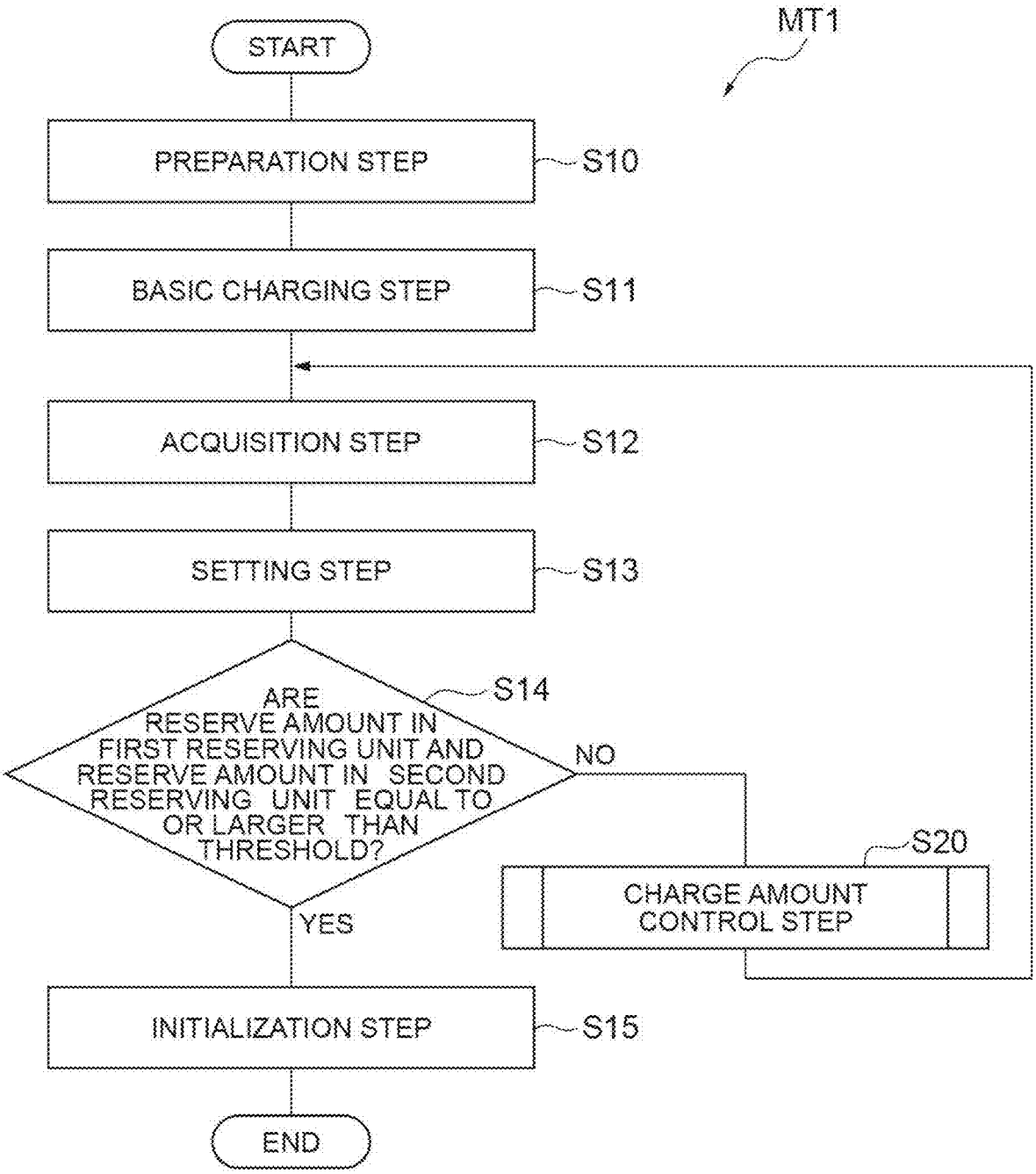
FIG. 5 is a flowchart illustrating an example of a foundry sand reserving method by the foundry sand reserving system according to the embodiment.

The foundry sand reserving system 1 executes a step of controlling at least one selected from the group consisting of the charge amount and the supply amount. FIG. 5 is a flowchart illustrating an example of the foundry sand reserving method according to the embodiment. A foundry sand reserving method MT1 illustrated in FIG. 5 is executed by the foundry sand reserving system 1 of the present embodiment. The foundry sand reserving method MT1 is a method for controlling, by the control device 80, the charge amounts of the foundry sand S to the first reserving unit 10A and the second reserving unit 10B from at least one selected from the group consisting of the first charging unit 30 and the second charging unit 40. For example, the foundry sand reserving method MT1 is started by the control device 80 at a predetermined timing in a state where the foundry sand S is reserved in the first reserving unit 10A and the second reserving unit 10B, and the foundry sand S is supplied from at least one selected from the group consisting of the first reserving unit 10A and the second reserving unit 10B and the supply unit 60 to the foundry sand related device 2. Note that, the supply control unit 88 stores, in the storage unit 82, the supply amounts of the foundry sand S from at least one selected from the group consisting of the first reserving unit 10A, the second reserving unit 10B and the supply unit 60 to the foundry sand related device 2.

Initially, as a preparation step (S10), the charging control unit 86 causes the first charging unit 30 and the second charging unit 40 to prepare the foundry sand S capable of being charged to the first reserving unit 10A. The preparation step (S10) is an example of a preparation step. For example, the charging control unit 86 measures the amount of the foundry sand and instructs the first supply source 31 and the second supply source 41 to supply the foundry sand such that appropriate amounts of foundry sand S are reserved.

Subsequently, as a basic charging step (S11), the charging control unit 86 charges predetermined amounts of foundry sand S from the first charging unit 30 to the first reserving unit 10A and the second reserving unit 10B. The basic charging step (S11) is an example of a step of charging the foundry sand from the first charging unit to the plurality of reserving units. The charging control unit 86 stores, in the storage unit 82, the charge amount of the foundry sand S from the first charging unit 30 to the first reserving unit 10A and the charge amount of the foundry sand S from the first charging unit 30 to the second reserving unit 10B.

Subsequently, as an acquisition step (S12), the acquisition unit 81 acquires the reserve amounts of the foundry sand S in the first reserving unit 10A and the second reserving unit 10B, the charge amounts of the foundry sand S to the first reserving unit 10A and the second reserving unit 10B, and the supply amount of the foundry sand S to the foundry sand related device 2. The acquisition step (S12) is an example of an acquisition step. The charge amounts of the foundry sand S to the first reserving unit 10A and the second reserving unit 10B includes the charge amounts of the foundry sand S from the first charging unit 30 to the first reserving unit 10A and the second reserving unit 10B, and the charge amounts of the foundry sand S from the second charging unit 40 to the first reserving unit 10A and the second reserving unit 10B. The supply amount of the foundry sand S to the foundry sand related device 2 includes the supply amount of the foundry sand S from the first reserving unit 10A to the foundry sand related device 2, the supply amount of the foundry sand S from the second reserving unit 10B to the foundry sand related device 2, and the supply amount of the foundry sand S from the supply unit 60 to the foundry sand related device 2. The acquisition step (S12) includes a measurement step of measuring the reserve amount in the first reserving unit 10A and the reserve amount in the second reserving unit 10B by the two measuring instruments 70 and 70. The measurement step is an example of a measurement step. The acquisition unit 81 acquires the reserve amount in the first reserving unit 10A and the reserve amount in the second reserving unit 10B measured from the measuring instruments 70 in the measurement step. The acquisition unit 81 acquires, from the storage unit 82, the charge amounts and the supply amounts set at the point in time when the reserve amounts of the foundry sand S in the first reserving unit 10A and the second reserving unit 10B are measured by the measuring instruments 70.

Subsequently, as a setting step (S13), the setting unit 83 sets the threshold for each reserve amount based on the aging time, each charge amount, and each supply amount acquired in the acquisition step (S12). The setting step (S13) is an example of a setting step. The setting unit 83 sets the threshold for the reserve amount in the first reserving unit 10A based on the aging time, the charge amount to the first reserving unit 10A, and the supply amount from the first reserving unit 10A to the foundry sand related device 2. The setting unit 83 sets the threshold for the reserve amount in the second reserving unit 10B based on the aging time, the charge amount to the second reserving unit 10B, and the supply amount from the second reserving unit 10B to the foundry sand related device 2. In the present embodiment, the size of the first reserving unit 10A and the size of the second reserving unit 10B are the same, and the threshold for the reserve amounts in the first reserving unit 10A and the reserve amount in the second reserving unit 10B are also the same.

Subsequently, as a first charging determination step (S14), the charging determination unit 85 determines whether or not the reserve amount in the first reserving unit 10A and the reserve amount in the second reserving unit 10B are equal to or larger than the threshold. In a case where the charging determination unit 85 determines that the reserve amount in the first reserving unit 10A and the reserve amount in the second reserving unit 10B are equal to or larger than the threshold, the charging control unit 86 proceeds to an initialization step (S15) as processing subsequent to the foundry sand reserving method MT1. In a case where the charging determination unit 85 determines that the reserve amount in the first reserving unit 10A and the reserve amount in the second reserving unit 10B are not equal to or larger than the threshold, the charging control unit 86 proceeds to a charge amount control step (S20) as processing subsequent to the foundry sand reserving method MT1.

Figure 6:
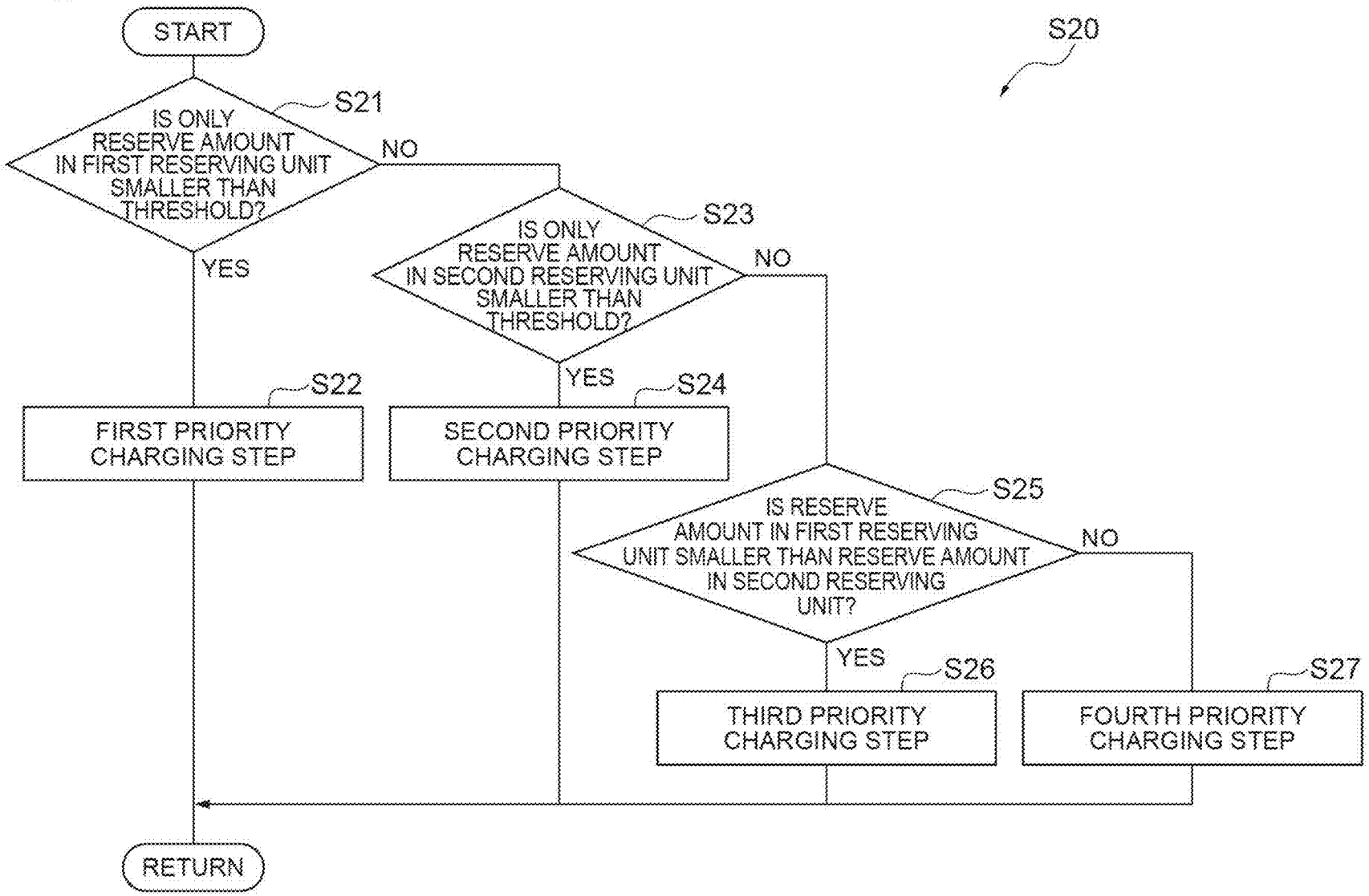
FIG. 6 is a flowchart illustrating an example of a step in the flowchart illustrated in FIG. 5.

In a case where it is determined that the reserve amount in the first reserving unit 10A and the reserve amount in the second reserving unit 10B are not equal to or larger than the threshold in the first charging determination step (S14) illustrated in FIG. 5, the charge amount control step (S20) illustrated in FIGS. 5 and 6 is performed. FIG. 6 is a flowchart illustrating an example of the step in the flowchart illustrated in FIG. 5. Hereinafter, the charge amount control step (S20) will be described with reference to FIG. 6.

As a second charging determination step (S21) which is an initial step of the charge amount control step (S20), the charging determination unit 85 determines whether or not only the reserve amount in the first reserving unit 10A is smaller than the threshold. In a case where the charging determination unit 85 determines that only the reserve amount in the first reserving unit 10A is smaller than the threshold, the charging control unit 86 proceeds to a first priority charging step (S22) as processing subsequent to the foundry sand reserving method MT1. In a case where the charging determination unit 85 determines that only the reserve amount in the first reserving unit 10A is not smaller than the threshold, the charging control unit 86 proceeds to a third charging determination step (S23) as processing subsequent to the foundry sand reserving method MT1.

In the second charging determination step (S21), in a case where it is determined that only the reserve amount in the first reserving unit 10A is smaller than the threshold, the first priority charging step (S22) is executed. As the first priority charging step (S22), the charging control unit 86 charges the foundry sand from the first charging unit 30 to the first reserving unit 10A in preference to the second reserving unit 10B. For example, the charging control unit 86 charges the foundry sand from the first charging unit 30 to the first reserving unit 10A such that the charge amount from the first charging unit 30 to the first reserving unit 10A after the second charging determination step (S21) is larger than the charge amount from the first charging unit 30 to the first reserving unit 10A before the second charging determination step (S21). For example, the charging control unit 86 controls the first charging unit 30 such that a proportion of the charge amount to the first reserving unit 10A is larger than a proportion of the charge amount to the second reserving unit 10B in the total amount of the foundry sand charged from the first charging unit 30 to the charging path 32. Specifically, the charging control unit 86 separates the charging gate 35 from the charging path 32 such that the opening degree of the charging gate 35 is becomes closer to the open state than to the closed state. When the first priority charging step (S22) is completed, the charge amount control step (S20) is ended, and the acquisition step (S12) illustrated in FIG. 5 is executed again.

In a case where it is determined that only the reserve amount in the first reserving unit 10A is not smaller than the threshold in the second charging determination step (S21), the third charging determination step (S23) is executed. As the third charging determination step (S23), the charging determination unit 85 determines whether or not only the reserve amount in the second reserving unit 10B is smaller than the threshold. In a case where the charging determination unit 85 determines that only the reserve amount in the second reserving unit 10B is smaller than the threshold, the charging control unit 86 proceeds to a second priority charging step (S24) as processing subsequent to the foundry sand reserving method MT1. In a case where the charging determination unit 85 determines that only the reserve amount in the second reserving unit 10B is not smaller than the threshold, the charging control unit 86 proceeds to a fourth charging determination step (S25) as processing subsequent to the foundry sand reserving method MT1. The case where it is determined that only the reserve amount in the second reserving unit 10B is not smaller than the threshold by the charging determination unit 85 in the third charging determination step (S23) is a case where the reserve amount in the first reserving unit 10A and the reserve amount in the second reserving unit 10B are smaller than the threshold.

In the third charging determination step (S23), in a case where it is determined that only the reserve amount in the second reserving unit 10B is smaller than the threshold, the second priority charging step (S24) is executed. As the second priority charging step (S24), the charging control unit 86 charges the foundry sand from the first charging unit 30 to the second reserving unit 10B in preference to the first reserving unit 10A. For example, the charging control unit 86 charges the foundry sand from the first charging unit 30 to the second reserving unit 10B such that the charge amount from the first charging unit 30 to the second reserving unit 10B after the third charging determination step (S23) is larger than the charge amount from the first charging unit 30 to the second reserving unit 10B before the third charging determination step (S23). For example, the charging control unit 86 controls the first charging unit 30 such that the proportion of the charge amount to the second reserving unit 10B is larger than the proportion of the charge amount to the first reserving unit 10A in the total amount of the foundry sand charged from the first charging unit 30 to the charging path 32. Specifically, the charging control unit 86 brings the charging gate 35 close to the charging path 32 such that the opening degree of the charging gate 35 becomes closer to the closed state than to the open state. When the second priority charging step (S24) is completed, the charge amount control step (S20) is ended, and the acquisition step (S12) illustrated in FIG. 5 is executed again.

In a case where it is determined that only the reserve amount in the second reserving unit 10B is not smaller than the threshold in the third charging determination step (S23), the fourth charging determination step (S25) is executed. As the fourth charging determination step (S25), the charging determination unit 85 determines whether or not the reserve amount in the first reserving unit 10A is smaller than the reserve amount in the second reserving unit 10B. In a case where the charging determination unit 85 determines that the reserve amount in the first reserving unit 10A is smaller than the reserve amount in the second reserving unit 10B, the charging control unit 86 proceeds to a third priority charging step (S26) as processing subsequent to the foundry sand reserving method MT1. In a case where the charging determination unit 85 determines that the reserve amount in the first reserving unit 10A is not smaller than the reserve amount in the second reserving unit 10B, the charging control unit 86 proceeds to the fourth charging determination step (S25) as processing subsequent to the foundry sand reserving method MT1.

In the fourth charging determination step (S25), in a case where it is determined that the reserve amount in the first reserving unit 10A is smaller than the reserve amount in the second reserving unit 10B, the third priority charging step (S26) is executed. As the third priority charging step (S26), the charging control unit 86 charges the foundry sand from the second charging unit 40 to at least one selected from the group consisting of the first reserving unit 10A and the second reserving unit 10B. At this time, the charging control unit 86 charges the foundry sand from the second charging unit 40 to the first reserving unit 10A in preference to the second reserving unit 10B. For example, the charging control unit 86 may charge the foundry sand from the second charging unit 40 only to the first reserving unit 10A. For example, the charging control unit 86 may charge the foundry sand from the second charging unit 40 to the first reserving unit 10A such that the charge amount from the second charging unit 40 to the first reserving unit 10A is larger than the charge amount from the second charging unit 40 to the second reserving unit 10B. For example, the charging control unit 86 may charge the foundry sand from the second charging unit 40 to the first reserving unit 10A such that the charge amount from the second charging unit 40 to the first reserving unit 10A after the fourth charging determination step (S25) is larger than the charge amount from the second charging unit 40 to the first reserving unit 10A before the fourth charging determination step (S25).

In addition, in the third priority charging step (S26), for example, the charging control unit 86 charges the foundry sand from the first charging unit 30 to the first reserving unit 10A such that the charge amount from the first charging unit 30 to the first reserving unit 10A after the fourth charging determination step (S25) is larger than the charge amount from the first charging unit 30 to the first reserving unit 10A before the fourth charging determination step (S25). For example, the charging control unit 86 controls the first charging unit 30 such that a proportion of the charge amount to the first reserving unit 10A is larger than a proportion of the charge amount to the second reserving unit 10B in the total amount of the foundry sand charged from the first charging unit 30 to the charging path 32. Specifically, the charging control unit 86 separates the charging gate 35 from the charging path 32 such that the opening degree of the charging gate 35 is becomes closer to the open state than to the closed state. When the third priority charging step (S26) is completed, the charge amount control step (S20) is ended, and the acquisition step (S12) illustrated in FIG. 5 is executed again.

In a case where it is determined that the reserve amount in the first reserving unit 10A is not smaller than the reserve amount in the second reserving unit 10B in the fourth charging determination step (S25), the fourth priority charging step (S27) is executed. As the fourth priority charging step (S27), the charging control unit 86 charges the foundry sand S from the second charging unit 40 to at least one selected from the group consisting of the first reserving unit 10A and the second reserving unit 10B. At this time, the charging control unit 86 charges the foundry sand from the second charging unit 40 to the second reserving unit 10B in preference to the first reserving unit 10A. For example, the charging control unit 86 may charge the foundry sand from the second charging unit 40 only to the second reserving unit 10B. For example, the charging control unit 86 may charge the foundry sand from the second charging unit 40 to the second reserving unit 10B such that the charge amount from the second charging unit 40 to the second reserving unit 10B is larger than the charge amount from the second charging unit 40 to the first reserving unit 10A. For example, the charging control unit 86 may charge the foundry sand from the second charging unit 40 to the second reserving unit 10B such that the charge amount from the second charging unit 40 to the second reserving unit 10B after the fourth charging determination step (S25) is larger than the charge amount from the second charging unit 40 to the second reserving unit 10B before the fourth charging determination step (S25).

In addition, in the fourth priority charging step (S27), for example, the charging control unit 86 charges the foundry sand from the first charging unit 30 to the second reserving unit 10B such that the charge amount from the first charging unit 30 to the second reserving unit 10B after the fourth charging determination step (S25) is larger than the charge amount from the first charging unit 30 to the second reserving unit 10B before the fourth charging determination step (S25). For example, the charging control unit 86 controls the first charging unit 30 such that the proportion of the charge amount to the second reserving unit 10B is larger than the proportion of the charge amount to the first reserving unit 10A in the total amount of the foundry sand charged from the first charging unit 30 to the charging path 32. Specifically, the charging control unit 86 brings the charging gate 35 close to the charging path 32 such that the opening degree of the charging gate 35 becomes closer to the closed state than to the open state. When the fourth priority charging step (S27) is completed, the charge amount control step (S20) is ended, and the acquisition step (S12) illustrated in FIG. 5 is executed again.

Referring back to FIG. 5, the description is continued. In the first charging determination step (S14), in a case where the charging determination unit 85 determines that the reserve amount in the first reserving unit 10A and the reserve amount in the second reserving unit 10B are equal to or larger than the threshold, the charging control unit 86 executes the initialization step (S15). In a case where the first priority charging step (S22), the second priority charging step (S24), the third priority charging step (S26), and the fourth priority charging step (S27) are executed before the initialization step (S15), the charging control unit 86 changes the charge amounts from the first charging unit 30 to the first reserving unit 10A and the second reserving unit 10B in the steps described above to the charge amounts from the first charging unit 30 to the first reserving unit 10A and the second reserving unit 10B in the basic charging step (S11). In addition, in a case where the third priority charging step (S26) and the fourth priority charging step (S27) are executed before the initialization step (S15), the charging control unit 86 stops the charging from the second charging unit 40 to the first reserving unit 10A and the second reserving unit 10B in the steps described above. Note that, in a case where the first priority charging step (S22), the second priority charging step (S24), the third priority charging step (S26), and the fourth priority charging step (S27) are not executed before the initialization step (S15), the processing is completed without executing any of the kinds of above-described processing. In a case where the initialization step (S15) is completed, the charging control unit 86 ends the flowchart in FIG. 5.

Figure 7:
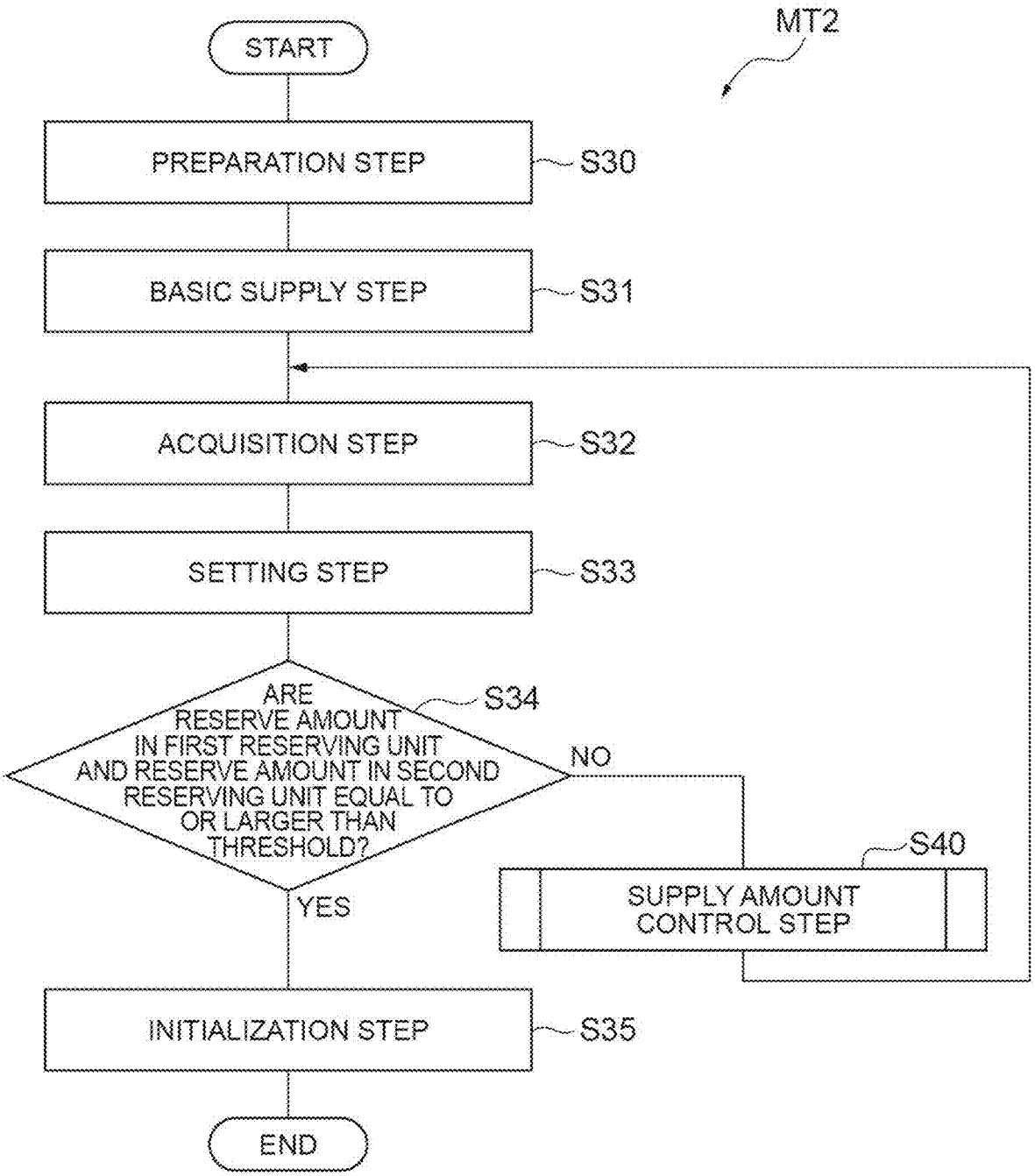
FIG. 7 is a flowchart illustrating an example of the foundry sand reserving method by the foundry sand reserving system according to the embodiment.

FIG. 7 is a flowchart illustrating an example of the foundry sand reserving method according to the embodiment. A foundry sand reserving method MT2 illustrated in FIG. 7 is executed by the foundry sand reserving system 1 of the present embodiment. The foundry sand reserving method MT2 is a method for controlling, by the control device 80, the supply amount of the foundry sand S from at least one selected from the group consisting of the first reserving unit 10A, the second reserving unit 10B, and the supply unit 60 to the foundry sand related device 2. Note that, the foundry sand reserving system 1 executes at least one selected from the group consisting of the foundry sand reserving methods MT1 and MT2. That is, the foundry sand reserving system 1 may simultaneously execute the foundry sand reserving methods MT1 and MT2, or may execute any one of the foundry sand reserving methods MT1 and MT2. For example, the foundry sand reserving method MT2 is started by the control device 80 at a predetermined timing in a state where the foundry sand S is reserved in the first reserving unit 10A and the second reserving unit 10B and is supplied from at least one selected from the group consisting of the first charging unit 30 and the second charging unit 40 to the first reserving unit 10A and the second reserving unit 10B. Note that, the charge amounts of the foundry sand S from the first charging unit 30 and the second charging unit 40 to the first reserving unit 10A and the second reserving unit 10B are stored in the storage unit 82 by the charging control unit 86.

Initially, as a preparation step (S30), the supply control unit 88 causes the supply unit 60 to prepare the foundry sand S capable of being supplied to the foundry sand related device 2. For example, the supply control unit 88 measures the amount of the foundry sand and instructs the third supply source 61 to supply the foundry sand such that appropriate amounts of foundry sand S are reserved.

Subsequently, as a basic supply step (S31), the supply control unit 88 supplies predetermined amounts of foundry sand S from the first reserving unit 10A and the second reserving unit 10B to the foundry sand related device 2. The basic supply step (S31) is an example of a step of supplying the foundry sand from the plurality of reserving units to the foundry sand related device. The supply control unit 88 stores, in the storage unit 82, the supply amount of the foundry sand S from the first reserving unit 10A to the foundry sand related device 2 and the supply amount of the foundry sand S from the second reserving unit 10B to the foundry sand related device 2.

Subsequently, as an acquisition step (S32), the acquisition unit 81 acquires the reserve amounts of the foundry sand S in the first reserving unit 10A and the second reserving unit 10B, the charge amounts of the foundry sand S to the first reserving unit 10A and the second reserving unit 10B, and the supply amount of the foundry sand S to the foundry sand related device 2. The acquisition step (S32) is the same processing as in the acquisition step (S12) illustrated in FIG. 5.

Subsequently, as a setting step (S33), the setting unit 83 sets the threshold for the reserve amounts based on the aging time and the charge amounts and the supply amounts acquired in the acquisition step (S32). The setting step (S33) is an example of a setting step. The setting step (S33) is the same processing as in the setting step (S13) illustrated in FIG. 5.

Subsequently, as a first supply determination step (S34), the supply determination unit 87 determines whether or not the reserve amount in the first reserving unit 10A and the reserve amount in the second reserving unit 10B are equal to or larger than the threshold. In a case where the supply determination unit 87 determines that the reserve amount in the first reserving unit 10A and the reserve amount in the second reserving unit 10B are equal to or larger than the threshold, the supply control unit 88 proceeds to an initialization step (S35) as processing subsequent to the foundry sand reserving method MT2. In a case where the supply determination unit 87 determines that the reserve amount in the first reserving unit 10A and the reserve amount in the second reserving unit 10B are not equal to or larger than the threshold, the supply control unit 88 proceeds to a supply amount control step (S40) as processing subsequent to the foundry sand reserving method MT2.

Figure 8:
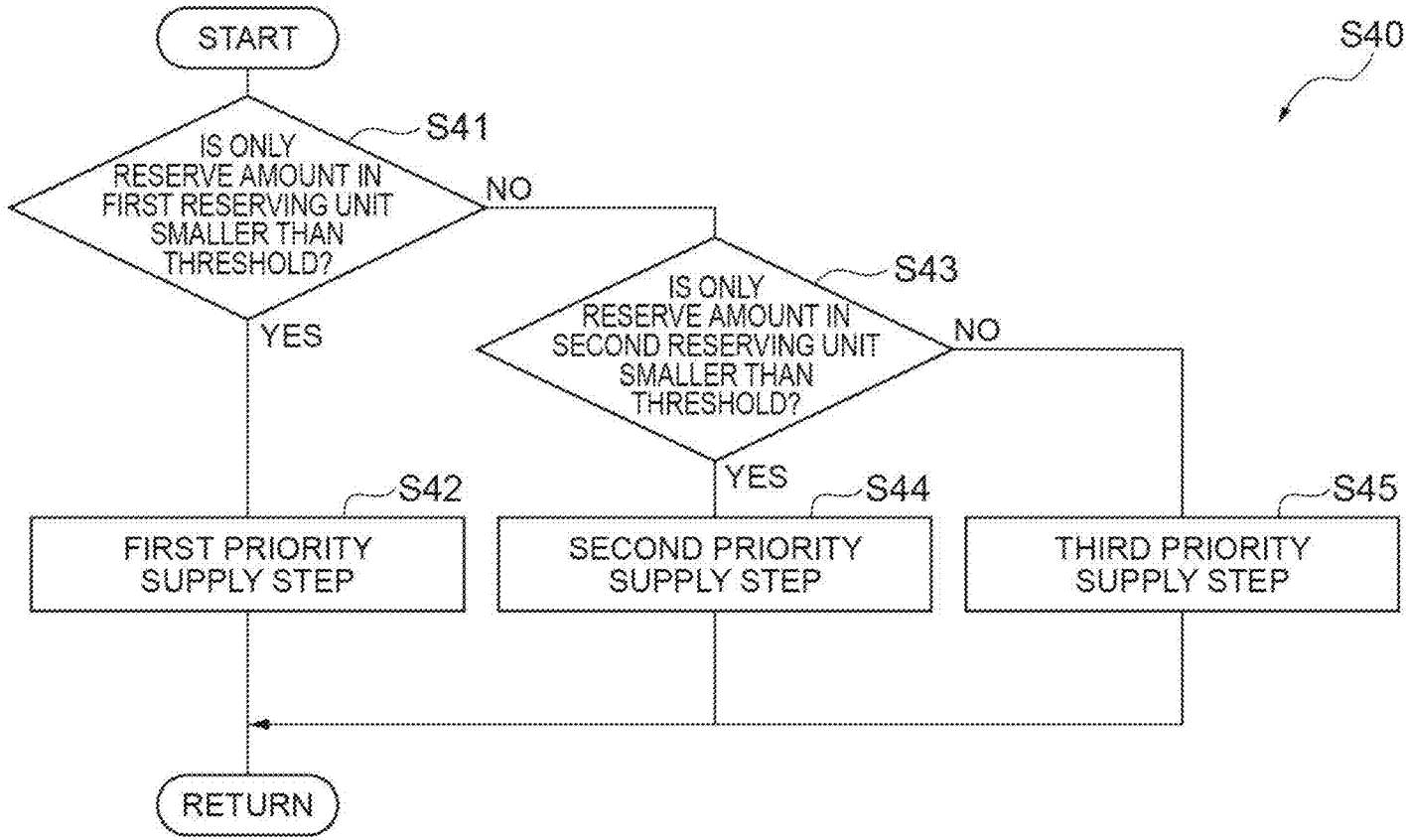
FIG. 8 is a flowchart illustrating an example of a step in the flowchart illustrated in FIG. 7.

In a case where it is determined that the reserve amount in the first reserving unit 10A and the reserve amount in the second reserving unit 10B are not equal to or larger than the threshold in the first supply determination step (S34) illustrated in FIG. 7, the supply amount control step (S40) illustrated in FIGS. 7 and 8 is performed. FIG. 8 is a flowchart illustrating an example of the step in the flowchart illustrated in FIG. 7. Hereinafter, the supply amount control step (S40) will be described with reference to FIG. 8.

As a second supply determination step (S41) which is an initial step of the supply amount control step (S40), the supply determination unit 87 determines whether or not only the reserve amount in the first reserving unit 10A is smaller than the threshold. In a case where the supply determination unit 87 determines that only the reserve amount in the first reserving unit 10A is smaller than the threshold, the supply control unit 88 proceeds to a first priority supply step (S42) as processing subsequent to the foundry sand reserving method MT2. In a case where the supply determination unit 87 determines that only the reserve amount in the first reserving unit 10A is not smaller than the threshold, the supply control unit 88 proceeds to a third supply determination step (S43) as processing subsequent to the foundry sand reserving method MT2.

In the second supply determination step (S41), in a case where it is determined that only the reserve amount in the first reserving unit 10A is smaller than the threshold, the first priority supply step (S42) is executed. As the first priority supply step (S42), the supply control unit 88 reduces the supply amount from the first reserving unit 10A to the foundry sand related device 2 in preference to the supply amount from the second reserving unit 10B to the foundry sand related device 2. For example, the supply control unit 88 supplies the foundry sand S from the first reserving unit 10A to the foundry sand related device 2 such that the supply amount from the first reserving unit 10A to the foundry sand related device 2 after the second supply determination step (S41) is smaller than the supply amount from the first reserving unit 10A to the foundry sand related device 2 before the second supply determination step (S41). For example, the supply control unit 88 controls the second discharge unit 20 of the first reserving unit 10A such that the proportion of the supply amount from the first reserving unit 10A to the foundry sand related device 2 is smaller than the proportion of the supply amount from the second reserving unit 10B to the foundry sand related device 2 in the total amount of the foundry sand S supplied to the unloading path 53 of the unloading unit 50. Specifically, the supply control unit 88 executes, on the second discharge unit 20 of the first reserving unit 10A, at least one selected from the group consisting of processing of lowering each discharge gate 21 to decrease the opening degree of each discharge gate 21 and processing of lowering the rotation speed of the rotary table 22. At this time, in order to set the supply amount of the foundry sand S to the foundry sand related device 2 in the unloading path 53 to be constant, the supply amount from the second reserving unit 10B to the foundry sand related device 2 is increased. Specifically, the supply control unit 88 executes, on the second discharge unit 20 of the second reserving unit 10B, at least one selected from the group consisting of processing of raising each discharge gate 21 to increase the opening degree of each discharge gate 21 and processing of raising the rotation speed of the rotary table 22. Accordingly, for example, the supply control unit 88 can increase or decrease the supply amount of the first reserving unit 10A and the supply amount of the second reserving unit 10B without changing the total amount of the supply amount of the foundry sand S to the foundry sand related device 2 from the first reserving unit 10A and the second reserving unit 10B supplied to the unloading path 53 of the unloading unit 50. When the first priority supply step (S42) is completed, the supply amount control step (S40) is ended, and the acquisition step (S32) illustrated in FIG. 7 is executed again.

In a case where it is determined that only the reserve amount of the first reserving unit 10A is not smaller than the threshold in the second supply determination step (S41), the third supply determination step (S43) is executed. As the third supply determination step (S43), the supply determination unit 87 determines whether or not only the reserve amount in the second reserving unit 10B is smaller than the threshold. In a case where the supply determination unit 87 determines that only the reserve amount in the second reserving unit 10B is smaller than the threshold, the supply control unit 88 proceeds to a second priority supply step (S44) as processing subsequent to the foundry sand reserving method MT2. In a case where the supply determination unit 87 determines that only the reserve amount in the second reserving unit 10B is not smaller than the threshold, the supply control unit 88 proceeds to a third priority supply step (S45) as processing subsequent to the foundry sand reserving method MT1. The case where it is determined that only the reserve amount in the second reserving unit 10B is not smaller than the threshold by the supply determination unit 87 in the third supply determination step (S43) is a case where the reserve amount in the first reserving unit 10A and the reserve amount in the second reserving unit 10B are smaller than the threshold.

In the third supply determination step (S43), in a case where it is determined that only the reserve amount in the second reserving unit 10B is smaller than the threshold, the second priority supply step (S44) is executed. As the second priority supply step (S44), the supply control unit 88 reduces the supply amount from the second reserving unit 10B to the foundry sand related device 2 in preference to the supply amount from the first reserving unit 10A to the foundry sand related device 2. For example, the supply control unit 88 supplies the foundry sand S from the second reserving unit 10B to the foundry sand related device 2 such that the supply amount from the second reserving unit 10B to the foundry sand related device 2 after the third supply determination step (S43) is smaller than the supply amount from the second reserving unit 10B to the foundry sand related device 2 before the third supply determination step (S43). For example, the supply control unit 88 controls the second discharge unit 20 of the second reserving unit 10B such that a proportion of the supply amount from the second reserving unit 10B is smaller than a proportion of the supply amount from the first reserving unit 10A in the total amount of the foundry sand S supplied to the unloading path 53 of the unloading unit 50. Specifically, the supply control unit 88 executes, on the second discharge unit 20 of the second reserving unit 10B, at least one selected from the group consisting of processing of lowering each discharge gate 21 to decrease the opening degree of each discharge gate 21 and processing of lowering the rotation speed of the rotary table 22. At this time, in order to set the supply amount of the foundry sand S to the foundry sand related device 2 in the unloading path 53 to be constant, the supply amount from the first reserving unit 10A to the foundry sand related device 2 is increased. Specifically, the supply control unit 88 executes, on the second discharge unit 20 of the first reserving unit 10A, at least one selected from the group consisting of processing of raising each discharge gate 21 to increase the opening degree of each discharge gate 21 and processing of raising the rotation speed of the rotary table 22. Accordingly, for example, the supply control unit 88 can increase or decrease the supply amount from the first reserving unit 10A to the foundry sand related device 2 and the supply amount from the second reserving unit 10B to the foundry sand related device 2 without changing the total amount of the supply amount of the foundry sand S from the first reserving unit 10A and the second reserving unit 10B supplied to the unloading path 53 of the unloading unit 50. When the second priority supply step (S44) is completed, the supply amount control step (S40) is ended, and the acquisition step (S32) illustrated in FIG. 7 is executed again.

In a case where it is determined that only the reserve amount in the second reserving unit 10B is not smaller than the threshold in the third supply determination step (S43), the third priority supply step (S45) is executed. As the third priority supply step (S45), the supply control unit 88 supplies the foundry sand from the supply unit 60 to the foundry sand related device 2. At this time, the supply control unit 88 reduces the supply amount from the first reserving unit 10A to the foundry sand related device 2 and the supply amount from the second reserving unit 10B to the foundry sand related device 2 from the supply amount from the first reserving unit 10A to the foundry sand related device 2 and the supply amount from the second reserving unit 10B to the foundry sand related device 2 before the third supply determination step (S43). For example, the supply control unit 88 reduces the supply amount from the first reserving unit 10A to the foundry sand related device 2 and the supply amount from the second reserving unit 10B to the foundry sand related device 2 in accordance with the reserve amount in the first reserving unit 10A and the reserve amount in the second reserving unit 10B. Further, the supply control unit 88 supplies the foundry sand S from the supply unit 60 to the foundry sand related device 2 such that the total amount of the supply amounts from the first reserving unit 10A and the second reserving unit 10B to the foundry sand related device 2 and the supply amount from the supply unit 60 to the foundry sand related device 2 becomes a predetermined set amount. The supply control unit 88 increases, for the supply unit 60, the opening degree of the gate for adjusting the amount of the foundry sand S, and sets the conveyance speed to the foundry sand related device 2 to an appropriate value. For example, the set amount is stored in the storage unit 82. For example, the supply control unit 88 causes the supply unit 60 to supply the foundry sand to the foundry sand related device 2 by an amount obtained by reducing the supply amount from each of the first reserving unit 10A and the second reserving unit 10B to the foundry sand related device 2. Accordingly, the supply control unit 88 can reduce the supply amount from the first reserving unit 10A to the foundry sand related device 2 and the supply amount from the second reserving unit 10B to the foundry sand related device 2 without changing the total amount of the supply amounts of the foundry sand S from the first reserving unit 10A and the second reserving unit 10B supplied to the unloading path 53 of the unloading unit 50 to the foundry sand related device 2. When the third priority supply step (S45) is completed, the supply amount control step (S40) is ended, and the acquisition step (S32) illustrated in FIG. 7 is executed again.

Referring back to FIG. 7, the description is continued. In a case where the supply determination unit 87 determines that the reserve amount in the first reserving unit 10A and the reserve amount in the second reserving unit 10B are equal to or larger than the threshold in the first supply determination step (S34), the supply control unit 88 executes the initialization step (S35). In a case where the first priority supply step (S42), the second priority supply step (S44), and the third priority supply step (S45) are executed before the initialization step (S35), the supply control unit 88 changes the supply amounts from the first reserving unit 10A and the second reserving unit 10B to the foundry sand related device 2 in the above-described steps to the supply amounts from the first reserving unit 10A and the second reserving unit 10B to the foundry sand related device 2 in the basic supply step (S31). In addition, in a case where the third priority supply step (S45) is executed before the initialization step (S35), the supply control unit 88 stops the supply from the supply unit 60 to the foundry sand related device 2. Note that, in a case where the first priority supply step (S42), the second priority supply step (S44), and the third priority supply step (S45) are not executed before the initialization step (S35), any processing is not executed. In a case where the initialization step (S35) is completed, the supply control unit 88 ends the flowchart illustrated in FIG. 7.

As described above, according to the foundry sand reserving methods MT1 and MT2 and the foundry sand reserving system 1, when the foundry sand S is newly charged in a state where the foundry sand S is already reserved in the first reserving unit 10A and the second reserving unit 10B, the newly charged foundry sand S can secure the aging time while the previously reserved foundry sand S is supplied to the foundry sand related device 2. At this time, in the foundry sand reserving method MT2, the supply amount supplied to the foundry sand related device 2 is controlled to be equal to or smaller than the reserve amount of the already reserved foundry sand S during the aging time of the newly charged foundry sand S, and thus, the supply of the newly charged foundry sand S from the first reserving unit 10A and the second reserving unit 10B to the foundry sand related device 2 before the aging time elapses is suppressed. The threshold in the foundry sand reserving methods MT1 and MT2 is, for example, the amount of the foundry sand S supplied to the foundry sand related device 2 during the aging time of the newly charged foundry sand S. Therefore, when the reserve amounts of the first reserving unit 10A and the second reserving unit 10B are equal to or larger than the threshold, the aging time of the newly charged foundry sand S can be appropriately secured.

In addition, in the foundry sand reserving method MT1, the charge amounts are controlled, and thus, the reserve amounts of the foundry sand S in the first reserving unit 10A and the second reserving unit 10B capable of being supplied to the foundry sand related device 2 can be appropriately controlled. As described above, the reserve amounts in the first reserving unit 10A and the second reserving unit 10B increase by the charge amounts, and decrease by the supply amounts.

In the setting steps (S13 and S23), the threshold for the reserve amounts is set based on the aging time, the charge amounts to the first reserving unit 10A and the second reserving unit 10B, and the supply amount to the foundry sand related device 2. In addition, at least one selected from the group consisting of the control of the charge amount in the charge amount control step (S20) of the foundry sand reserving method MT1 and the control of the supply amount in the supply amount control step (S40) of the foundry sand reserving method MT2 is executed, and thus, the control can be performed such that, for example, the foundry sand S in the first reserving unit 10A (second reserving unit 10B) has a reserve amount equal to or larger than the threshold. As described above, the reserve amount in the first reserving unit 10A (second reserving unit 10B) is controlled, and thus, the aging time of the foundry sand can be appropriately secured. Therefore, the foundry sand reserving system 1 and the foundry sand reserving methods MT1 and MT2 can appropriately secure the aging time of the foundry sand.

In addition, the foundry sand reserving system 1 includes the measuring instruments 70 that include at least one selected from the group consisting of the microwave sensor, the millimeter wave sensor, and the sounding level gauge and measure the reserve amounts of the first reserving unit 10A and the second reserving unit 10B in the measurement step during the acquisition steps (S12 and S32). Accordingly, the foundry sand reserving methods MT1 and MT2 and the foundry sand reserving system 1 can appropriately measure the reserve amount regardless of the type of the foundry sand S. In addition, the measuring instrument 70 can measure the reserve amount more accurately than a case where a level switch measures the reserve amount. Further, the measuring instrument 70 can suppress the occurrence of a defect due to the influence of interference as compared with a case where an ultrasonic sensor measures the reserve amount.

In addition, the measuring instrument 70 includes a microwave sensor provided at a position where the microwave can be applied in a direction intersecting the inclined surface of the deposit SV1 of the foundry sand S having the inclined surface at the repose angle that can be formed in the first reserving unit 10A. In this case, the measuring instrument 70 can more accurately receive the microwave reflected by the inclined surface by applying the microwave in the direction intersecting the inclined surface of the deposit SV1 of the foundry sand S.

In addition, in the foundry sand reserving methods MT1 and MT2 and the foundry sand reserving system 1, in a case where the reserve amount in the first reserving unit 10A (second reserving unit 10B) is larger than a predetermined upper limit, the first discharge unit 12 discharges the foundry sand S exceeding the upper limit from the first reserving unit 10A (second reserving unit 10B) to the preservation unit 15. In this case, the foundry sand S in the first reserving unit 10A (the second reserving unit 10B) can be kept at a reserve amount equal to or smaller than the upper limit. Accordingly, overflowing of the foundry sand S from the first reserving unit 10A (the second reserving unit 10B) can be suppressed. Note that, the first discharge unit 12 may constantly discharge the foundry sand S exceeding the upper limit during the execution of the foundry sand reserving methods MT1 and MT2.

In addition, the control step of the foundry sand reserving method MT1 and the foundry sand reserving system 1 includes, as the first priority charging step (S22), a step of charging the foundry sand S from the first charging unit 30 to the first reserving unit 10A such that the charge amount from the first charging unit 30 to the first reserving unit 10A after the second charging determination step (S21) is larger than the charge amount from the first charging unit 30 to the first reserving unit 10A before the second charging determination step (S21) in a case where it is determined that the reserve amount in the first reserving unit 10A is smaller than the threshold and the reserve amount in the second reserving unit 10B is equal to or larger than the threshold in the second charging determination step (S21). The control step of the foundry sand reserving method MT1 and the foundry sand reserving system 1 includes, as the second priority charging step (S24), a step of charging the foundry sand S from the first charging unit 30 to the second reserving unit 10B such that the charge amount from the first charging unit 30 to the second reserving unit 10B after the third charging determination step (S23) is larger than the charge amount from the first charging unit 30 to the second reserving unit 10B before the third charging determination step (S23) in a case where it is determined that the reserve amount in the second reserving unit 10B is smaller than the threshold and the reserve amount in the first reserving unit 10A is equal to or larger than the threshold in the third charging determination step (S23). There is a possibility that the aging time of the foundry sand S in the reserving unit 10 having a smaller reserve amount than another reserving unit 10 is shorter than the aging time of the foundry sand in the other reserving unit 10. According to the present disclosure, the foundry sand S is charged to the reserving unit 10 having a smaller reserve amount from the first charging unit 30 to have a larger charge amount than the charge amount to the other reserving unit 10, and thus, the reserve amount can be increased such that the aging time equivalent to the foundry sand S in the other reserving unit 10 can be secured.

In addition, the control step of the foundry sand reserving method MT1 and the foundry sand reserving system 1 include, as the third priority charging step (S26) and the fourth priority charging step (S27), a step of charging the foundry sand to at least one reserving unit of the first reserving unit 10A and the second reserving unit 10B from the second charging unit 40 in a case where it is determined that the reserve amounts in the first reserving unit 10A and the second reserving unit 10B are smaller than the threshold in the third charging determination step (S23). In a case where the reserve amounts in the first reserving unit 10A and the second reserving unit 10B are smaller than the threshold, even in a case where the charge amounts from the first charging unit 30 to the first reserving unit 10A and the second reserving unit 10B are changed, in a case where the total amount of the foundry sand S charged from the first charging unit 30 is constant, a time until the reserve amounts in the first reserving unit 10A and the second reserving unit 10B become equal to or larger than the threshold does not change before and after the change. In the present disclosure, when the charge amounts are controlled for the reserve amounts in the first reserving unit 10A and the second reserving unit 10B, in a case where the reserve amounts in the first reserving unit 10A and the second reserving unit 10B are smaller than the threshold, the charging of the foundry sand from the second charging unit 40 is performed in addition to the charging of the foundry sand S from the first charging unit 30. Thus, as compared with a case where the foundry sand S is charged to the first reserving unit 10A and the second reserving unit 10B only from the first charging unit 30, more foundry sand S is charged to the first reserving unit 10A and the second reserving unit 10B. Therefore, the reserve amounts in the first reserving unit 10A and the second reserving unit 10B can be set to be equal to or larger than the threshold in a shorter time, and the reserve amounts in the first reserving unit 10A and the second reserving unit 10B capable of being supplied to the foundry sand related device 2 can be appropriately increased. In addition, the aging time of the foundry sand S to be charged thereafter can be appropriately secured.

In addition, the control step of the foundry sand reserving method MT1 and the foundry sand reserving system 1 includes, as the third priority charging step (S26), a step of charging the foundry sand S from the first charging unit 30 to the first reserving unit 10A having a smaller reserve amount than the reserve amount of the second reserving unit 10B such that the charge amount from the first charging unit 30 to the first reserving unit 10A after the third charging determination step (S23) is larger than the charge amount from the first charging unit 30 to the first reserving unit 10A before the third charging determination step (S23). In addition, the foundry sand reserving method MT1 includes, as the fourth priority charging step (S27), a step of charging the foundry sand S from the first charging unit 30 to the second reserving unit 10B having a smaller reserve amount than the reserve amount in the first reserving unit 10A such that the charge amount from the first charging unit 30 to the second reserving unit 10B after the third charging determination step (S23) is larger than the charge amount from the first charging unit 30 to the second reserving unit 10B before the third charging determination step (S23). In this case, the foundry sand S is preferentially charged to at least one reserving unit 10 having a small reserve amount by the first charging unit 30, and thus, the reserve amount in the at least one reserving unit 10 increases in a shorter time. Accordingly, the reserve amount of the foundry sand S in the reserving unit 10 capable of being supplied to the foundry sand related device 2 can be appropriately increased. In addition, the aging time for the foundry sand S to be charged thereafter can be secured.

In addition, the control step of the foundry sand reserving method MT1 and the foundry sand reserving system 1 includes, as the third priority charging step (S26), a step of charging the foundry sand S from the second charging unit 40 to the first reserving unit 10A having a smaller reserve amount than the reserve amount of the second reserving unit 10B such that the charge amount from the second charging unit 40 to the first reserving unit 10A after the third charging determination step (S23) is larger than the charge amount from the second charging unit 40 to the first reserving unit 10A before the third charging determination step (S23). In addition, the foundry sand reserving method MT1 includes, as the fourth priority charging step (S27), a step of charging the foundry sand S from the second charging unit 40 to the second reserving unit 10B having a smaller reserve amount than the reserve amount in the first reserving unit 10A such that the charge amount from the second charging unit 40 to the second reserving unit 10B after the third charging determination step (S23) is larger than the charge amount from the second charging unit 40 to the second reserving unit 10B before the third charging determination step (S23). In this case, the foundry sand S is preferentially charged to at least one reserving unit 10 having a small reserve amount by the second charging unit 40, and thus, the reserve amount in the at least one reserving unit 10 increases in a shorter time. Accordingly, the reserve amount of the foundry sand S in the reserving unit 10 capable of being supplied to the foundry sand related device 2 can be appropriately increased. In addition, the aging time for the foundry sand S to be charged thereafter can be secured.

In addition, the control step of the foundry sand reserving method MT2 and the foundry sand reserving system 1 further include, as the first priority supply step (S42), a step of performing control such that the total amount of the supply amounts from the first reserving unit 10A and the second reserving unit 10B to the foundry sand related device 2 becomes a predetermined set amount while reducing the supply amount from the first reserving unit 10A to the foundry sand related device 2 from the supply amount from the first reserving unit 10A to the foundry sand related device 2 before the second supply determination step (S41) in a case where it is determined that the reserve amount in the first reserving unit 10A is smaller than the threshold and the reserve amount in the second reserving unit 10B is equal to or larger than the threshold in the second supply determination step (S41). In addition, the control step of the foundry sand reserving method MT2 and the foundry sand reserving system 1 further include, as the second priority supply step (S44), a step of performing control such that the total amount of the supply amounts from the first reserving unit 10A and the second reserving unit 10B to the foundry sand related device 2 becomes a predetermined set amount while reducing the supply amount from the second reserving unit 10B to the foundry sand related device 2 from the supply amount from the second reserving unit 10B to the foundry sand related device 2 before the third supply determination step (S43) in a case where it is determined that the reserve amount in the second reserving unit 10B is smaller than the threshold and the reserve amount in the first reserving unit 10A is equal to or larger than the threshold in the third supply determination step (S43). In this case, there is a possibility that the aging time of the foundry sand S in the reserving unit 10 having a smaller reserve amount than another reserving unit 10 is shorter than the aging time of the foundry sand S in the other reserving unit 10. According to the present disclosure, the supply amount to the foundry sand related device 2 from the reserving unit 10 having a smaller reserve amount than the supply amount to the foundry sand related device 2 from the other reserving unit 10 is reduced, and thus, the reduction in the reserve amount can be suppressed to secure the aging time equivalent to the foundry sand S in the other reserving unit 10.

In addition, the control step of the foundry sand reserving method MT2 and the foundry sand reserving system 1 further includes, as the third priority supply step (S45), a step of supplying the foundry sand from the supply unit 60 to the foundry sand related device 2 when it is determined that the reserve amounts in the first reserving unit 10A and the second reserving unit 10B are smaller than the threshold in the third supply determination step (S43). In this case, when the supply amounts from the plurality of reserving units 10 to the foundry sand related device 2 are controlled, in a case where the reserve amount in each of the plurality of reserving units 10 is smaller than the threshold, the supply of the foundry sand S from the supply unit 60 to the foundry sand related device 2 is performed in addition to the supply of the foundry sand S from the plurality of reserving units 10 to the foundry sand related device 2. Thus, according to the above configuration, the supply amount of the foundry sand S from the plurality of reserving units 10 to the foundry sand related device 2 can be further decreased than in a case where the foundry sand S is supplied from only the plurality of reserving units 10 to the foundry sand related device 2. Therefore, a decrease rate of the reserve amounts in the plurality of reserving units 10 can be suppressed, and the reduction in the reserve amounts of the foundry sand S in the reserving units 10 capable of being supplied to the foundry sand related device 2 can be appropriately suppressed.

In addition, the control step of the foundry sand reserving method MT2 and the foundry sand reserving system 1 include, as the third priority supply step (S45), a step of supplying the foundry sand S from the supply unit 60 to the foundry sand related device 2 such that the total amount of the supply amounts from the first reserving unit 10A and the second reserving unit 10B to the foundry sand related device 2 and the supply amount from the supply unit 60 to the foundry sand related device 2 becomes a predetermined set amount while reducing the supply amounts from the first reserving unit 10A and the second reserving unit 10B to the foundry sand related device 2 from the supply amounts from the first reserving unit 10A and the second reserving unit 10B to the foundry sand related device 2 before the third supply determination step (S43). In a case where the reserve amounts in the plurality of reserving units 10 are smaller than the threshold, even in a case where the supply amount from the at least one reserving unit 10 to the foundry sand related device 2 is reduced, in a case where the total amount of the foundry sand S supplied from all the plurality of reserving units 10 is constant, the supply amounts from another reserving units 10 to the foundry sand related device 2 merely increase, and a time until the reserve amounts in the plurality of reserving units 10 become equal to or larger than the threshold does not change before and after the increase or decrease of the supply amount. In the present disclosure, since the set amount of foundry sand S is supplied to the foundry sand related device 2 by the plurality of reserving units 10 and the supply unit 60, the supply amounts of the foundry sand S from the plurality of reserving units 10 to the foundry sand related device 2 can be further decreased as compared with a case where the foundry sand S is supplied to the foundry sand related device 2 only from the plurality of reserving units 10. Therefore, a decrease rate of the reserve amounts in the plurality of reserving units 10 can be suppressed, and the reduction in the reserve amounts of the foundry sand S in the reserving units 10 capable of being supplied to the foundry sand related device 2 can be appropriately suppressed.

Modification of Foundry Sand Reserving Method and Foundry Sand Reserving System Although the present embodiment has been described above, it is needless to say that the present invention is not limited to the above-described present embodiment, and various modifications can be made other than the present embodiment without departing from the gist thereof. The drive unit 23 may not control the elevation driving of at least the plurality of discharge gates 21. For example, the worker may move the plurality of discharge gates 21 to the position in the open state or the position in the closed state by operating the plurality of discharge gates 21. In addition to the processing of controlling the opening degree of the charging gate 35 in the second charging guide unit 34, the charging control unit 86 may charge the charge amount by the processing in the first charging unit 30. In a case where the charge amount is changed, the charging control unit 86 may control, for the first charging unit 30, the opening degree of the gate for adjusting the amount of the foundry sand S in the first supply source 31, the conveyance speed of the foundry sand S in the charging path 32, and the like. In addition, the third supply source 61 may not adjust the amount of the foundry sand S to be supplied by the opening degree of the gate (not illustrated). In this case, in the third priority supply step (S45), the supply unit 60 may supply the preset amount to the foundry sand related device 2. At this time, the supply unit 60 may realize only both the states of the state where the gate is open or the state where the gate is closed without finely adjusting the opening degree of the gate. At this time, the supply control unit 88 reduces the supply amount from the first reserving unit 10A to the foundry sand related device 2 and the supply amount from the second reserving unit 10B to the foundry sand related device 2 in accordance with the supply amount from the supply unit 60 to the foundry sand related device 2.

For example, the foundry sand reserving system 1 may include three or more reserving units 10. For example, the foundry sand reserving system 1 may include one reserving unit 10. Hereinafter, a foundry sand reserving system according to a modification will be described with reference to FIGS. 9 and 10. The foundry sand reserving system according to the modification is different from the foundry sand reserving system 1 illustrated in FIG. 1 in that the foundry sand reserving system includes one reserving unit as at least one reserving unit and the first charging unit 30, the second charging unit 40, and the unloading unit 50 do not have a configuration for the second reserving unit 10B. One reserving unit in the foundry sand reserving system according to the modification has the same configuration as the first reserving unit 10A. In the following description, one reserving unit in the foundry sand reserving system according to the modification is referred to as a reserving unit 10. The reference signs of the other components in the foundry sand reserving system according to the modification are the same as those of the components of the foundry sand reserving system 1 described above.

Figure 9:
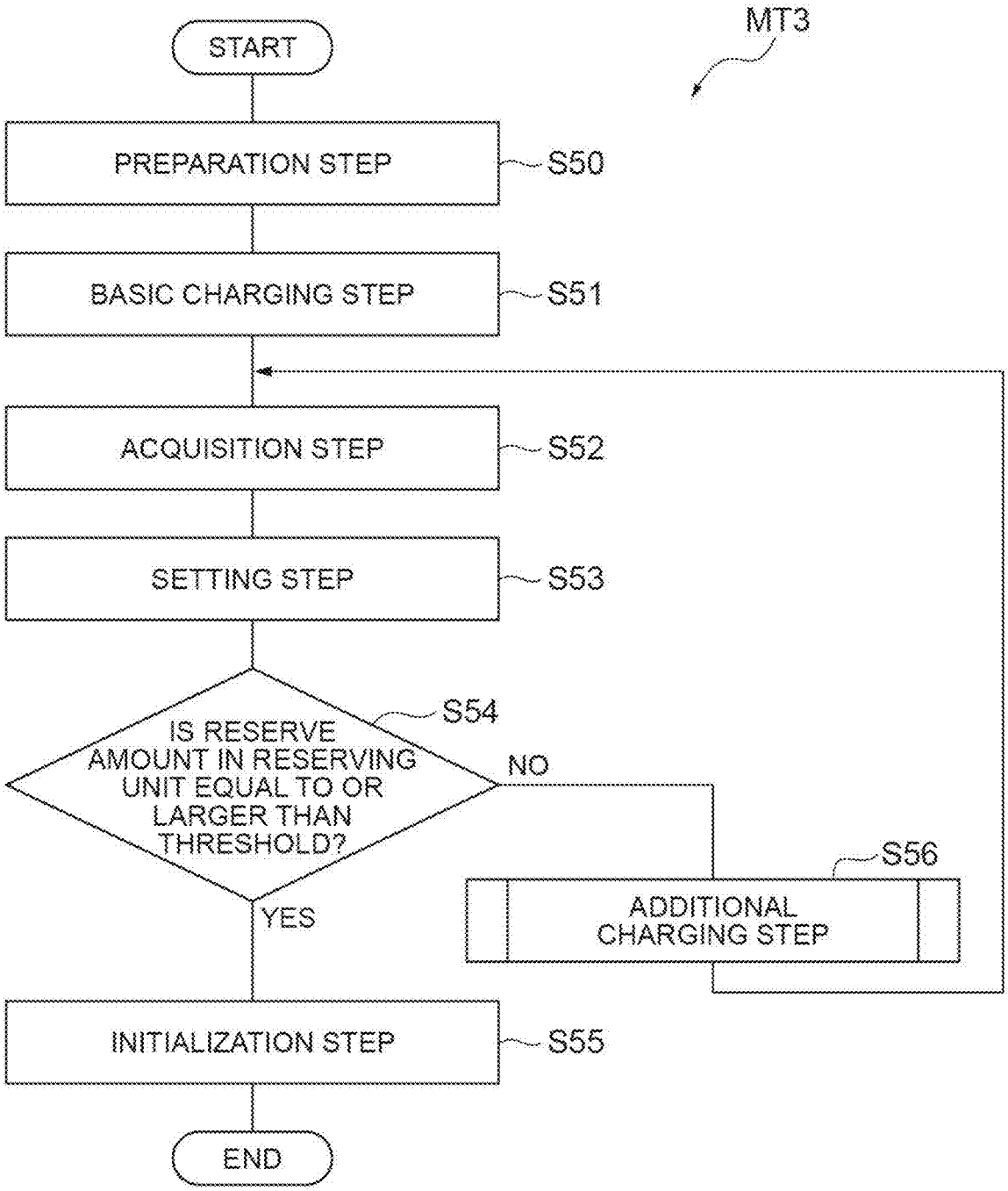
FIG. 9 is a flowchart illustrating an example of a foundry sand reserving method by a foundry sand reserving system according to a modification.

FIG. 9 is a flowchart illustrating an example of a foundry sand reserving method by the foundry sand reserving system according to the modification. A foundry sand reserving method MT3 illustrated in FIG. 9 is executed by the foundry sand reserving system according to the modification. The foundry sand reserving method MT3 is a method of controlling the charge amount of the foundry sand S from at least one selected from the group consisting of the first charging unit 30 and the second charging unit 40 to the reserving unit 10 by the control device 80. For example, the foundry sand reserving method MT3 is started by the control device 80 at a predetermined timing in a state where the foundry sand S is reserved in the reserving unit 10 and the foundry sand S is supplied from at least one selected from the group consisting of the reserving unit 10 and the supply unit 60 to the foundry sand related device 2. Note that, the supply control unit 88 stores, in the storage unit 82, the supply amounts of the foundry sand S from at least one selected from the group consisting of the reserving unit 10 and the supply unit 60 to the foundry sand related device 2.

Initially, as a preparation step (S50), the charging control unit 86 causes the first charging unit 30 and the second charging unit 40 to prepare the foundry sand S capable of being charged to the reserving unit 10. The preparation step (S50) is the same processing as the preparation step (S10) illustrated in FIG. 5.

Subsequently, as a basic charging step (S51), the charging control unit 86 charges a predetermined amount of foundry sand S from the first charging unit 30 to the reserving unit 10. The basic charging step (S51) is an example of a step of charging the foundry sand from the first charging unit to one reserving unit. The charging control unit 86 stores, in the storage unit 82, the charge amount of the foundry sand S from the first charging unit 30 to the reserving unit 10.

Subsequently, as an acquisition step (S52), the acquisition unit 81 acquires the reserve amount of the foundry sand S in the reserving unit 10, the charge amount of the foundry sand S to the reserving unit 10, and the supply amount of the foundry sand S to the foundry sand related device 2. The acquisition step (S52) is an example of an acquisition step. The charge amount of the foundry sand S to the reserving unit 10 includes the charge amount of the foundry sand S from the first charging unit 30 to the reserving unit 10 and the charge amount of the foundry sand S from the second charging unit 40 to the reserving unit 10. The supply amount of the foundry sand S to the foundry sand related device 2 includes the supply amount of the foundry sand S from the reserving unit 10 to the foundry sand related device 2 and the supply amount of the foundry sand S from the supply unit 60 to the foundry sand related device 2. The measurement step includes a measurement step of measuring the reserve amount in the reserving unit 10 by the measuring instrument 70. The measurement step is an example of a measurement step. The acquisition unit 81 acquires the reserve amount in the reserving unit 10 measured from the measuring instrument 70 in the measurement step. The acquisition unit 81 acquires, from the storage unit 82, the charge amount and the supply amount set at a point in time when the reserve amount of the foundry sand S in the reserving unit 10 is measured by the measuring instrument 70.

Subsequently, as a setting step (S53), the setting unit 83 sets the threshold for the reserve amount based on the aging time, and the charge amount and the supply amount acquired in the acquisition step (S52). The setting step (S53) is an example of a setting step. The setting unit 83 sets the threshold for the reserve amount in the reserving unit 10 based on the aging time, the charge amount to the reserving unit 10, and the supply amount from the reserving unit 10 to the foundry sand related device 2.

Subsequently, as a charging determination step (S54), the charging determination unit 85 determines whether or not the reserve amount in the reserving unit 10 is equal to or larger than the threshold. In a case where the charging determination unit 85 determines that the reserve amount in the reserving unit 10 is equal to or larger than the threshold, the charging control unit 86 proceeds to an initialization step (S55) as processing subsequent to the foundry sand reserving method MT3. In a case where the charging determination unit 85 determines that the reserve amount in the reserving unit 10 is not equal to or larger than the threshold (smaller than the threshold), the charging control unit 86 proceeds to an additional charging step (S56) as processing subsequent to the foundry sand reserving method MT3.

In a case where it is determined that the reserve amount in one reserving unit 10 is not equal to or larger than the threshold (smaller than the threshold) in the charging determination step (S54), the additional charging step (S56) is performed. As the additional charging step (S56), the charging control unit 86 charges the foundry sand S from the second charging unit 40 to the reserving unit 10. When the additional charging step (S56) is completed, the acquisition step (S52) is executed again.

In a case where the charging determination unit 85 determines that the reserve amount in the reserving unit 10 is equal to or larger than the threshold in the charging determination step (S54), the charging control unit 86 executes the initialization step (S55). In a case where the additional charging step (S56) is executed before the initialization step (S55), the charging control unit 86 stops the charging from the second charging unit 40 to the reserving unit 10 in the additional charging step (S56). Note that, in a case where the additional charging step (S56) is not executed before the initialization step (S55), the above-described processing is not executed and is completed. In a case where the initialization step (S55) is completed, the charging control unit 86 ends the flowchart in FIG. 9.

Figure 10:
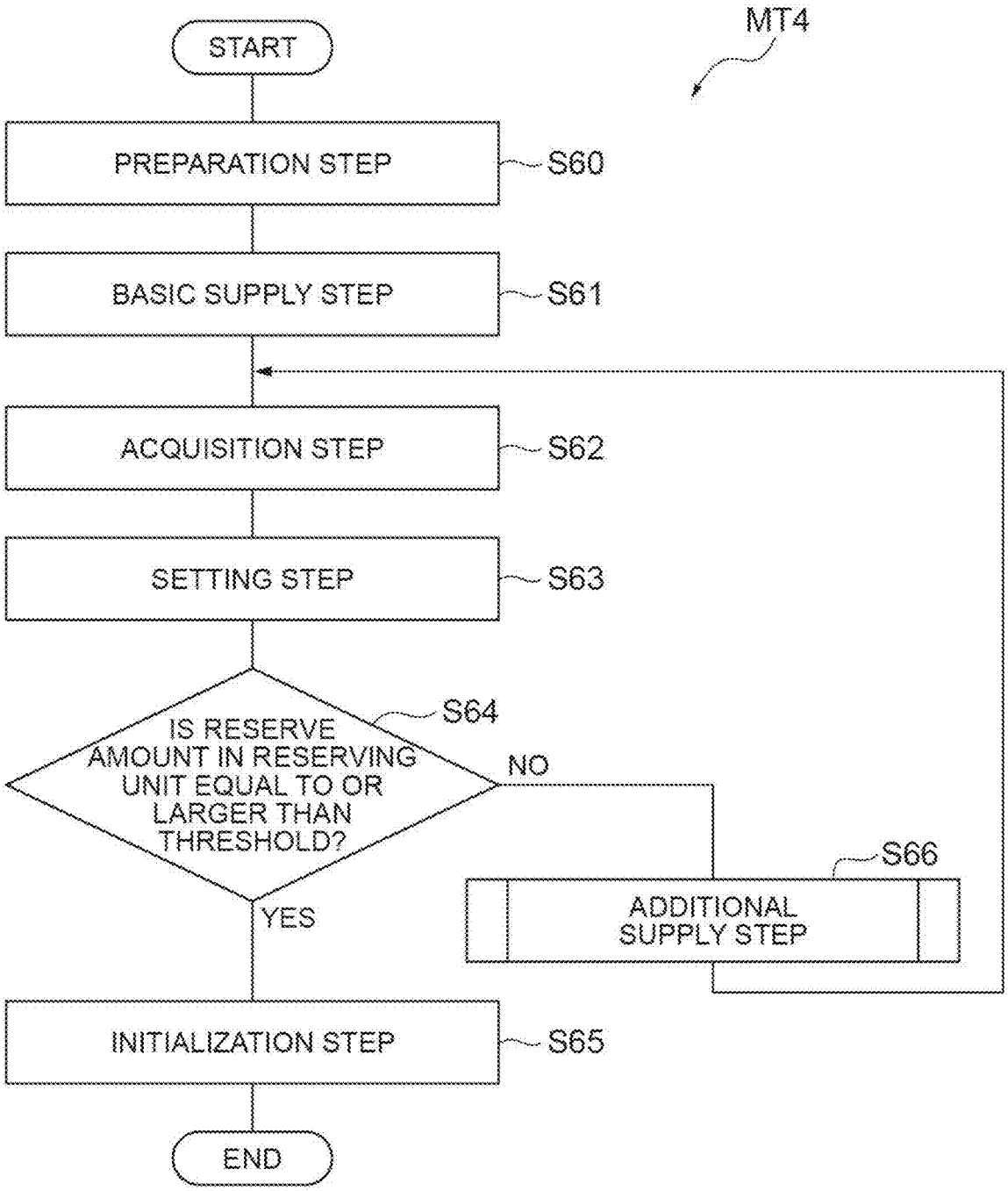
FIG. 10 is a flowchart illustrating an example of the foundry sand reserving method by the foundry sand reserving system according to the modification.

FIG. 10 is a flowchart illustrating an example of the foundry sand reserving method by the foundry sand reserving system according to the modification. A foundry sand reserving method MT4 illustrated in FIG. 10 is executed by the foundry sand reserving system according to the modification. The foundry sand reserving method MT4 is a method for controlling, by the control device 80, controlling the supply amount of the foundry sand S from at least one selected from the group consisting of the reserving unit 10 and the supply unit 60 to the foundry sand related device 2. Note that, the foundry sand reserving system according to the modification executes at least one selected from the group consisting of the foundry sand reserving methods MT3 and MT4. That is, the foundry sand reserving system according to the modification may simultaneously execute the foundry sand reserving methods MT3 and MT4, or may execute any one of the foundry sand reserving methods MT3 and MT4. For example, the foundry sand reserving method MT4 is started by the control device 80 at a predetermined timing in a state where the foundry sand S is reserved in the reserving unit 10 and the foundry sand S is supplied from at least one selected from the group consisting of the first charging unit 30 and the second charging unit 40 to the reserving unit 10. Note that, the charge amounts of the foundry sand S from the first charging unit 30 and the second charging unit 40 to the reserving unit 10 are stored in the storage unit 82 by the charging control unit 86.

Initially, as a preparation step (S60), the supply control unit 88 causes the supply unit 60 to prepare the foundry sand S capable of being supplied to the foundry sand related device 2. The preparation step (S60) is the same processing as the preparation step (S30) illustrated in FIG. 7.

Subsequently, as a basic supply step (S61), the supply control unit 88 supplies a predetermined amount of foundry sand S from the reserving unit 10 to the foundry sand related device 2. The basic supply step (S61) is an example of a step of supplying the foundry sand from one reserving unit to the foundry sand related device. The supply control unit 88 stores, in the storage unit 82, the supply amount of the foundry sand S from the reserving unit 10 to the foundry sand related device 2.

Subsequently, in an acquisition step (S62), the acquisition unit 81 acquires the reserve amount of the foundry sand S in the reserving unit 10, the charge amount of the foundry sand S to the reserving unit 10, and the supply amount of the foundry sand S to the foundry sand related device 2. The acquisition step (S62) is the same processing as the acquisition step (S52) illustrated in FIG. 9.

Subsequently, as a setting step (S63), the setting unit 83 sets the threshold for the reserve amount based on the aging time, and the charge amount and the supply amount acquired in the acquisition step (S62). The setting step (S63) is an example of a setting step. The setting step (S63) is the same processing as the setting step (S53) illustrated in FIG. 9.

Subsequently, as a supply determination step (S64), the supply determination unit 87 determines whether or not the reserve amount in the reserving unit 10 is equal to or larger than the threshold. In a case where the supply determination unit 87 determines that the reserve amount in the reserving unit 10 is equal to or larger than the threshold, the supply control unit 88 proceeds to an initialization step (S65) as processing subsequent to the foundry sand reserving method MT4. In a case where the supply determination unit 87 determines that the reserve amount in the reserving unit 10 is not equal to or larger than the threshold (smaller than the threshold), the supply control unit 88 proceeds to an additional supply step (S66) as processing subsequent to the foundry sand reserving method MT4.

In a case where it is determined that the reserve amount in one reserving unit 10 is not equal to or larger than the threshold (smaller than the threshold) in the supply determination step (S64), the additional supply step (S66) is performed. As the additional supply step (S66), the supply control unit 88 supplies the foundry sand S from the supply unit 60 to the foundry sand related device 2. At this time, the supply control unit 88 reduces the supply amount from one reserving unit 10, and supplies the foundry sand S from the supply unit 60 to the foundry sand related device 2 such that the total amount of the supply amount from one reserving unit 10 to the foundry sand related device 2 and the supply amount from the supply unit 60 to the foundry sand related device 2 becomes a predetermined set amount. When the additional supply step (S66) is completed, the acquisition step (S62) is executed again.

In a case where the supply determination unit 87 determines that the reserve amount in the reserving unit 10 is equal to or larger than the threshold in the supply determination step (S64), the supply control unit 88 executes the initialization step (S65). In a case where the additional supply step (S66) is executed before the initialization step (S65), the supply control unit 88 stops the charging from the supply unit 60 to the foundry sand related device 2 in the additional supply step (S66). Note that, in a case where the additional supply step (S66) is not executed before the initialization step (S65), the above-described processing is not executed and is completed. In a case where the initialization step (S65) is completed, the supply control unit 88 ends the flowchart illustrated in FIG. 10.

As described above, in the foundry sand reserving system and the foundry sand reserving methods MT3 and MT4 according to the modification, the aging time of the foundry sand can be appropriately secured by an action similar to the action of the foundry sand reserving system 1 and the foundry sand reserving methods MT1 and MT2 described above. In addition, the control step of the foundry sand reserving method MT3 and the foundry sand reserving system 1 include, as the additional charging step (S56), a step of charging the foundry sand S from the second charging unit 40 to the one reserving unit 10 in a case where it is determined that the reserve amount in one reserving unit 10 is smaller than the threshold in the charging determination step (S54). In this case, when the charge amount is controlled for the reserve amount in one reserving unit 10, in a case where the reserve amount is smaller than the threshold, the charging of the foundry sand from the second charging unit 40 is performed in addition to the charging of the foundry sand S from the first charging unit 30. Accordingly, as compared with a case where the foundry sand S is charged to one reserving unit 10 only from the first charging unit 30, more foundry sand S is charged to the one reserving unit 10. Therefore, the reserve amount in the one reserving unit 10 can be set to be equal to or larger than the threshold in a shorter time, and the aging time of the foundry sand S to be charged can be appropriately secured.

In addition, the control step of the foundry sand reserving method MT4 and the foundry sand reserving system 1 include, as the additional supply step (S66), a step of reducing the supply amount from one reserving unit 10 and supplying the foundry sand S from the supply unit 60 to the foundry sand related device 2 such that the total amount of the supply amount from one reserving unit 10 and the supply amount from the supply unit 60 becomes a predetermined set amount in a case where it is determined that the reserve amount in one reserving unit 10 is smaller than the threshold in the supply determination step (S64). In this case, a decrease rate of the reserve amount in one reserving unit 10 in which the reserve amount is smaller than the threshold can be reduced, and the aging time of the foundry sand S in the one reserving unit 10 can be appropriately secured. In addition, the foundry sand is supplied from the supply unit 60 to the foundry sand related device 2, and thus, a certain amount of foundry sand can be supplied to the foundry sand related device 2 by one reserving unit 10 and one supply unit 60.

Outline of Embodiment of Present Disclosure

The present disclosure includes the following aspects.

(Clause 1) A foundry sand reserving method according to an aspect of the present disclosure includes receiving (a reserving step), acquiring (an acquisition step), setting (a setting step), and controlling (a control step). The reserving (a reserving step) includes reserving foundry sand capable of being supplied to a foundry sand related device in at least one reserving unit. The acquiring (an acquisition step) includes acquiring a reserve amount of the foundry sand in at least one reserving unit, a charge amount of the foundry sand to the reserving unit, and a supply amount of the foundry sand to a foundry sand related device. The setting (the setting step) includes setting a threshold for the reserve amount based on a predetermined aging time of the foundry sand and the charge amount and the supply amount acquired in the acquiring (the acquisition step). The controlling (the control step), at least one selected from the group consisting of the charge amount and the supply amount based on the reserve amount acquired in the acquiring (the acquisition step) and the threshold set in the setting (step).

According to this foundry sand reserving method, when the foundry sand is newly charged in a state where the foundry sand is already reserved in the reserving unit, the newly charged foundry sand can secure the aging time while the already reserved foundry sand is supplied to the foundry sand related device. At this time, for example, the supply amount of the newly charged foundry sand supplied to the foundry sand related device during the aging time of the newly charged foundry sand is controlled to be equal to or smaller than the reserve amount of the previously reserved foundry sand, and thus, the supply of the newly charged foundry sand from the reserving unit to the foundry sand related device before the aging time elapses is suppressed. In addition, the charge amount is controlled, and thus, the reserve amount of the foundry sand in the reserving unit capable of being supplied to the foundry sand related device can be appropriately controlled. The reserve amount in the reserving unit increases by the charge amount and decreases by the supply amount. Here, in the setting step, the threshold for the reserve amount is set based on the aging time, the charge amount, and the supply amount. In the control step, at least one selected from the group consisting of the charge amount and the supply amount is controlled, and thus, for example, the foundry sand in the reserving unit can be controlled to have the reserve amount equal to or larger than the threshold. As described above, the reserve amount in the reserving unit is controlled, and thus, the aging time of the foundry sand can be appropriately secured. Therefore, this foundry sand reserving method can appropriately secure the aging time of the foundry sand.

(Clause 2) In the foundry sand reserving method according to Clause 1, the acquiring (the acquisition step) may include measuring the reserve amount by at least one selected from the group consisting of a microwave sensor, a millimeter wave sensor, and a sounding level gauge. In this case, since the reserve amount is measured by at least one selected from the group consisting of the microwave sensor, the millimeter wave sensor, and the sounding level gauge, the reserve amount can be measured more accurately than in a case where the reserve amount is measured by the level switch.

(Clause 3) In the foundry sand reserving method according to Clause 1 or 2, the reserving (the reserving step) may include reserving the foundry sand in one reserving unit as the at least one reserving unit, and the controlling (the control step) may include causing a first charging unit and a second charging unit to prepare the foundry sand capable of being charged to the one reserving unit, charging (the charging step) the foundry sand to the one reserving unit from the first charging unit, and charging (the charging step) the foundry sand to the one reserving unit from the second charging unit in a case where it is determined that the reserve amount in the one reserving unit is smaller than the threshold. In this case, when the charge amount is controlled for the reserve amount in one reserving unit, in a case where the reserve amount is smaller than the threshold, the charging of the foundry sand from the second charging unit is performed in addition to the charging of the foundry sand from the first charging unit. Accordingly, as compared with a case where the foundry sand is charged to one reserving unit only from the first charging unit, more foundry sand is charged to the one reserving unit. Therefore, the reserve amount in the one reserving unit can be set to be equal to or larger than the threshold in a shorter time, and the aging time of the charged foundry sand can be appropriately secured.

(Clause 4) In the foundry sand reserving method according to Clause 1 or 2, the reserving (the reserving step) may include reserving the foundry sand in a plurality of reserving units as the at least one reserving unit, and the controlling (the control step) may include causing a first charging unit to prepare the foundry sand capable of being charged to the plurality of reserving units, charging the foundry sand from the first charging unit to the plurality of reserving units, and charging the foundry sand from the first charging unit to the at least one reserving unit such that the charge amount is larger than the charge amount to the at least one reserving unit from the first charging unit before the determination in a case where it is determined that the reserve amount in at least one reserving unit among the plurality of reserving units is smaller than the threshold and the reserve amount in another reserving unit among the plurality of reserving units is equal to or larger than the threshold. There is a possibility that the aging time of the foundry sand in the reserving unit having a smaller reserve amount than in the other reserving unit is shorter than the aging time of the foundry sand in the other reserving unit. According to the present disclosure, the foundry sand is charged from the first charging unit to the reserving unit having a smaller reserve amount to increase the charge amount as compared with the charge amount to the other reserving unit, and thus, the reserve amount can be increased such that the aging time equivalent to the foundry sand in the other reserving unit can be secured.

(Clause 5) In the foundry sand reserving method according to Clause 1 or 2, the reserving (the reserving step) may include reserving the foundry sand in a plurality of reserving units as the at least one reserving unit, and the controlling (the control step) may include causing a first charging unit and a second charging unit to prepare the foundry sand capable of being charged to the plurality of reserving units, charging the foundry sand to the plurality of reserving units from the first charging unit, and charging the foundry sand to at least one reserving unit among the plurality of reserving units from the second charging unit in a case where the reserve amounts in the plurality of reserving units are smaller than the threshold. In a case where the reserve amounts of the plurality of reserving units are smaller than the threshold, even in a case where the charge amount from the first charging unit to each reserving unit is changed, the time until the reserve amounts in the plurality of reserving units becomes equal to or larger than the threshold does not change before and after the change in a case where the total amount of the foundry sand charged from the first charging unit is constant. In the present disclosure, when the charge amount is controlled for the reserve amounts in the plurality of reserving units, in a case where the reserve amounts in the plurality of reserving units are smaller than the threshold, the charging of the foundry sand from the second charging unit is performed in addition to the charging of the foundry sand from the first charging unit. Thus, as compared with a case where the foundry sand is charged to the plurality of reserving units only from the first charging unit, more foundry sand is charged to the plurality of reserving units. Therefore, the reserve amounts in the plurality of reserving units can be set to be equal to or larger than the threshold in a shorter time, and the reserve amount of the foundry sand in the reserving unit capable of being supplied to the foundry sand related device can be appropriately increased. In addition, the aging time of the foundry sand to be charged thereafter can be appropriately secured.

(Clause 6) In the foundry sand reserving method according to Clause 5, the controlling (the control step) may include a step of charging the foundry sand from the first charging unit to at least one reserving unit having a smaller reserve amount than in another reserving unit among the plurality of receiving units such that the charge amount is larger than the charge amount to the at least one reserving unit from the first charging unit before the determination. In this case, the foundry sand is preferentially charged to at least one reserving unit having a small reserve amount by the first charging unit, and thus, the reserve amount in the at least one reserving unit increases in a shorter time. Accordingly, the reserve amount of the foundry sand in the reserving unit capable of being supplied to the foundry sand related device can be appropriately increased. In addition, the aging time for the foundry sand to be charged thereafter can be secured.

(Clause 7) In the foundry sand reserving method according to Clause 5 or 6, the controlling (the control step) may include charging the foundry sand from the second charging unit to at least one reserving unit having a smaller reserve amount than another reserving unit among the plurality of receiving units such that the charge amount is larger than the charge amount to the at least one reserving unit from the second charging unit before the determination. In this case, the foundry sand is preferentially charged to at least one reserving unit having a small reserve amount by the second charging unit, and thus, the reserve amount in the at least one reserving unit increases in a shorter time. The reserve amount of the foundry sand in the reserving unit capable of being supplied to the foundry sand related device can be appropriately increased. In addition, the aging time for the foundry sand to be charged thereafter can be secured.

(Clause 8) In the foundry sand reserving method according to any one of Clauses 1 to 3, the reserving (the reserving step) may include reserving the foundry sand in one reserving unit as the at least one reserving unit, and the controlling (the control step) may include causing a supply unit to prepare the foundry sand capable of being supplied to the foundry sand related device, supplying the foundry sand from the one reserving unit to the foundry sand related device, and reducing the supply amount from the one reserving unit and supplying the foundry sand from the supply unit to the foundry sand related device such that a total amount of the supply amount from the one reserving unit and the supply amount from the supply unit becomes a predetermined set amount in a case where it is determined that the reserve amount in the one reserving unit is smaller than the threshold. In this case, the decrease rate of the reserve amount in one reserving unit in which the reserve amount is smaller than the threshold can be reduced, and the aging time of the foundry sand in the one reserving unit can be appropriately secured. In addition, the foundry sand is supplied from the supply unit to the foundry sand related device, and thus, a certain amount of foundry sand can be supplied to the foundry sand related device by one reserving unit and one supply unit.

(Clause 9) In the foundry sand reserving method according to any one of Clauses 1, 2, and 4, The reserving (the reserving step) may include reserving the foundry sand in a plurality of reserving units as the at least one reserving unit, and the controlling (the control step) may include supplying the foundry sand to the foundry sand related device from the plurality of reserving units, and performing control such that a total amount of the supply amounts from the plurality of reserving units becomes a predetermined set amount while reducing the supply amount from the at least one reserving unit from the supply amount from the at least one reserving unit before the determination in a case where it is determined that the reserve amount in the at least one reserving unit among the plurality of reserving units is smaller than the threshold and the reserve amount in another reserving unit among the plurality of reserving units is equal to or larger than the threshold. In this case, there is a possibility that the aging time of the foundry sand in the reserving unit having a reserve amount smaller than in the other reserving unit is shorter than the aging time of the foundry sand in the other reserving unit. According to the present disclosure, the supply amount from the reserving unit having a smaller reserve amount to the foundry sand related device is reduced as compared with the supply amount from the other reserving unit to the foundry sand related device, and thus, the reduction in the reserve amount can be suppressed such that the aging time equivalent to the foundry sand in the other reserving unit can be secured.

(Clause 10) In the foundry sand reserving method according to any one of Clauses 1, 2, and 5 to 7, the reserving (the reserving step) may include reserving the foundry sand in a plurality of reserving units as the at least one reserving unit, and the controlling (the control step) may include causing a supply unit to prepare the foundry sand capable of being supplied to the foundry sand related device, supplying the foundry sand from the plurality of reserving units to the foundry sand related device, and supplying the foundry sand from the supply unit to the foundry sand related device in a case where it is determined that the reserve amounts in the plurality of reserving units are smaller than the threshold. In this case, when the supply amounts from the plurality of reserving units to the foundry sand related device are controlled, in a case where the reserve amounts in the plurality of reserving units are smaller than the threshold, the supply of the foundry sand from the supply unit to the foundry sand related device is performed in addition to the supply of the foundry sand from the plurality of reserving units to the foundry sand related device. Thus, according to the above configuration, for example, the supply amount of foundry sand from the plurality of reserving units to the foundry sand related device can be further reduced as compared with a case where the foundry sand is supplied from only the plurality of reserving units to the foundry sand related device. Therefore, the decrease rate of the reserve amounts in the plurality of reserving units can be suppressed, and the decrease in the reserve amount of the foundry sand in the reserving unit capable of being supplied to the foundry sand related device can be appropriately suppressed.

(Clause 11) In the foundry sand reserving method according to Clause 10, the controlling (the control step) may include supplying the foundry sand to the foundry sand related device from the supply unit such that a total amount of the supply amounts from the plurality of reserving units and the supply amount from the supply unit becomes a predetermined set amount while reducing the supply amounts from the plurality of reserving units from the supply amounts from the plurality of reserving units before the determination. In a case where the reserve amounts in the plurality of reserving units are smaller than the threshold, even in a case where the supply amount of the foundry sand from at least one selected from the group consisting of the plurality of reserving units to the foundry sand related device is reduced, in a case where the total amount of the foundry sand supplied from all the plurality of reserving units is constant, the supply amount from the other reserving unit only increases, and the time until the reserve amounts in the plurality of reserving units becomes equal to or larger than the threshold does not change before and after the increase or decrease of the supply amount. In the present disclosure, since the set amount of foundry sand is supplied to the foundry sand related device by the plurality of reserving units and the supply unit, the supply amounts of the foundry sand from the plurality of reserving units to the foundry sand related device can be further reduced as compared with a case where the foundry sand is supplied to the foundry sand related device only from the plurality of reserving units. Therefore, the decrease rate of the reserve amounts in the plurality of reserving units can be suppressed, and the decrease in the reserve amount of the foundry sand in the reserving unit capable of being supplied to the foundry sand related device can be appropriately suppressed.

(Clause 12) A foundry sand reserving system according to another aspect of the present disclosure includes at least one reserving unit and a control device. The at least one reserving unit reserves foundry sand capable of being supplied to a foundry sand related device. The control device controls at least one selected from the group consisting of a charge amount of the foundry sand to the reserving unit and a supply amount of the foundry sand to the foundry sand related device. The control device includes an acquisition unit, a setting unit, and a control unit. The acquisition unit acquires the reserve amount of the foundry sand in the at least one reserving unit, the charge amount, and the supply amount. The setting unit sets a threshold for the reserve amount based on a predetermined aging time of the foundry sand and the charge amount and the supply amount acquired by the acquisition unit. The control unit controls at least one selected from the group consisting of the charge amount and the supply amount based on the reserve amount acquired by the acquisition unit and the threshold.

(Clause 13) The foundry sand reserving system according to Clause 12 may further include a measuring instrument that includes at least one selected from the group consisting of a microwave sensor, a millimeter wave sensor, and a sounding level gauge, and is configured to measure the reserve amount, and the acquisition unit may acquire the reserve amount measured by the measuring instrument. In this case, the effects similar to Clause 2 are obtained.

(Clause 14) In the foundry sand reserving system according to Clause 13, the measuring instrument may include a microwave sensor that is provided at a position where microwave is capable of being applied in a direction intersecting an inclined surface of a deposit of the foundry sand having the inclined surface at a repose angle capable of being formed in the at least one reserving unit. In this case, the measuring instrument can more accurately receive the microwave reflected by the inclined surface by applying the microwave to the inclined surface of the deposit of the foundry sand in the direction intersecting the inclined surface.

(Clause 15) The foundry sand reserving system according to any one of Clauses 12 to 14 may further include a preservation unit configured to preserve the foundry sand exceeding a predetermined upper limit discharged from the at least one reserving unit in a case where the reserve amount is larger than the upper limit. Accordingly, the overflowing of the foundry sand from the reserving unit can be suppressed.

(Clause 16) In the foundry sand reserving system according to any one of Clauses 12 to 14, one reserving unit may be provided as the at least one reserving unit, the foundry sand reserving system may further include a first charging unit and a second charging unit configured to charge the foundry sand to the one reserving unit, and the control unit may charge the foundry sand to the one reserving unit from the first charging unit, and charge the foundry sand to the at least one reserving unit from the second charging unit in a case where the reserve amount in the one reserving unit is smaller than the threshold. In this case, the effects similar to Clause 3 are obtained.

(Clause 17) In the foundry sand reserving system according to any one of Clauses 12 to 15, a plurality of reserving units may be provided as the at least one reserving unit, the foundry sand reserving system may further include a first charging unit configured to charge the foundry sand to the plurality of reserving units, and the control unit may charge the foundry sand to the plurality of reserving units from the first charging unit, and charge the foundry sand from the first charging unit such that the charge amount is larger than the charge amount to the at least one reserving unit from the first charging unit before the determination in a case where it is determined that the reserve amount in the at least one reserving unit among the plurality of reserving units is smaller than the threshold and the reserve amount in another reserving unit among the plurality of reserving units is equal to or larger than the threshold. In this case, the effects similar to Clause 4 are obtained.

(Clause 18) In the foundry sand reserving system according to any one of Clauses 12 to 14, a plurality of reserving units may be provided as the at least one reserving unit, the foundry sand reserving system may further include a first charging unit and a second charging unit configured to charge the foundry sand to the plurality of reserving units, and the control unit may charge the foundry sand to the plurality of reserving units from the first charging unit, and charge the foundry sand from the second charging unit to the at least one reserving unit among the plurality of reserving units in a case where it is determined that the reserve amounts in the plurality of reserving units are smaller than the threshold. In this case, the effects similar to Clause 5 are obtained.

(Clause 19) In the foundry sand reserving system according to any one of Clauses 12 to 14 and 16, one reserving unit may be provided as the at least one reserving unit, the foundry sand reserving system may further include a supply unit configured to supply the foundry sand to the foundry sand related device, and the control unit may supply the foundry sand to the foundry sand related device from the one reserving unit, and reduce the supply amount from the one reserving unit, and supply the foundry sand from the supply unit to the foundry sand related device such that a total amount of the supply amount from the one reserving unit and the supply amount from the supply unit becomes a predetermined set amount in a case where it is determined that the reserve amount in the one reserving unit is smaller than the threshold. In this case, the effects similar to Clause 8 are obtained.

(Clause 20) In the foundry sand reserving system according to any one of Clauses 12 to 14 and 17, a plurality of reserving units may be provided as the at least one reserving unit, the foundry sand reserving system may further include a supply unit configured to supply the foundry sand to the foundry sand related device, and the control unit may supply the foundry sand from the plurality of reserving units to the foundry sand related device, and perform control such that a total amount of the supply amounts from the plurality of reserving units becomes a predetermined set amount while reducing the supply amount form the at least one reserving unit from the supply amount from the at least one reserving unit before the determination in a case where the reserve amount in the at least one reserving unit among the plurality of reserving units is smaller than the threshold and the reserve amount in another reserving unit among the plurality of reserving units is equal to or larger than the threshold. In this case, the effects similar to Clause 9 are obtained.

(Clause 21) In the foundry sand reserving system according to any one of Clauses 12 to 14, 17, 18, and 20, the control unit may charge the foundry sand from the first charging unit to at least one reserving unit having a smaller reserve amount than in another reserving unit among the plurality of reserving units such that the charge amount is larger than the charge amount to the at least one reserving unit from the first charging unit before the determination. In this case, the effects similar to Clause 6 are obtained.

(Clause 22) In the foundry sand reserving system according to any one of Clauses 12 to 14, 17, 18, 20, and 21, the control unit may charge the foundry sand from the second charging unit to at least one reserving unit having a smaller reserve amount than in another reserving unit among the plurality of receiving units such that the charge amount is larger than the charge amount to the at least one reserving unit from the second charging unit before the determination. In this case, the effects similar to Clause 7 are obtained.

(Clause 23) In the foundry sand reserving system according to any one of Clauses 12 to 14, 18, and 21, a plurality of reserving units may be provided as the at least one reserving unit, the foundry sand reserving system may further include a supply unit configured to supply the foundry sand to the foundry sand related device, and the control unit may supply the foundry sand to the foundry sand related device from the plurality of reserving units, and supply the foundry sand to the foundry sand related device from the supply unit in a case where it is determined that the reserve amounts in the plurality of reserving units are smaller than the threshold. In this case, the effects similar to Clause 10 are obtained.

(Clause 24) In the foundry sand reserving system according to any one of Clauses 12 to 14, 18, and 21, the control unit may supply the foundry sand to the foundry sand related device from the supply unit such that a total amount of the supply amounts from the plurality of reserving units and the supply amount from the supply unit becomes a predetermined set amount while reducing the supply amounts from the plurality of reserving units from the supply amounts from the plurality of reserving units before the determination. In this case, the effects similar to Clause 11 are obtained.

What is claimed is:

1. A foundry sand reserving system comprising:

at least one reserving unit configured to reserve foundry sand capable of being supplied to a foundry sand related device; and a control device configured to control at least one selected from the group consisting of a charge amount of the foundry sand to the at least one reserving unit and a supply amount of the foundry sand to the foundry sand related device, wherein the control device includes an acquisition unit configured to acquire a reserve amount of the foundry sand in the at least one reserving unit, the charge amount, and the supply amount, a setting unit configured to set a threshold for the reserve amount based on a predetermined aging time of the foundry sand, and the charge amount and the supply amount acquired by the acquisition unit, and a control unit configured to control at least one selected from the group consisting of the charge amount and the supply amount based on the reserve amount acquired by the acquisition unit and the threshold.

2. The foundry sand reserving system according to claim 1, further comprising:

a measuring instrument that includes at least one selected from the group consisting of a microwave sensor, a millimeter wave sensor, and a sounding level gauge, and is configured to measure the reserve amount, wherein the acquisition unit acquires the reserve amount measured by the measuring instrument.

3. The foundry sand reserving system according to claim 2, wherein the measuring instrument includes a microwave sensor that is provided at a position where microwave is capable of being applied in a direction intersecting an inclined surface of a deposit of the foundry sand having the inclined surface at a repose angle capable of being formed in the at least one reserving unit.

4. The foundry sand reserving system according to claim 1, further comprising:

a preservation unit configured to preserve the foundry sand exceeding a predetermined upper limit discharged from the at least one reserving unit in a case where the reserve amount is larger than the upper limit.

5. The foundry sand reserving system according to claim 1, wherein one reserving unit is provided as the at least one reserving unit, the foundry sand reserving system further includes a first charging unit and a second charging unit configured to charge the foundry sand to the one reserving unit, and the control unit charges the foundry sand to the one reserving unit from the first charging unit, and charges the foundry sand to the at least one reserving unit from the second charging unit in a case where the reserve amount in the one reserving unit is smaller than the threshold.

6. The foundry sand reserving system according to claim 1, wherein a plurality of reserving units is provided as the at least one reserving unit, the foundry sand reserving system further includes a first charging unit configured to charge the foundry sand to the plurality of reserving units, and the control unit charges the foundry sand to the plurality of reserving units from the first charging unit, and charges the foundry sand from the first charging unit in a case where it is determined that the reserve amount in the at least one reserving unit among the plurality of reserving units is smaller than the threshold and the reserve amount in another reserving unit among the plurality of reserving units is equal to or larger than the threshold, wherein the foundry sand is charged from the first charging unit such that a charging amount to the at least one reserving unit from the first charging unit, after it is determined that the reserve amount in the at least one reserving unit is smaller than the threshold and the reserve amount in another reserving unit is equal to or larger than the threshold, is larger than a charge amount to the at least one reserving unit from the first charging unit, before it is determined that the reserve amount in the at least one reserving unit is smaller than the threshold and the reserve amount in another reserving unit is equal to or larger than the threshold.

7. The foundry sand reserving system according to claim 1, wherein a plurality of reserving units is provided as the at least one reserving unit, the foundry sand reserving system further includes a first charging unit and a second charging unit configured to charge the foundry sand to the plurality of reserving units, and the control unit charges the foundry sand to the plurality of reserving units from the first charging unit, and charges the foundry sand from the second charging unit to the at least one reserving unit among the plurality of reserving units in a case where it is determined that the reserve amounts in the plurality of reserving units are smaller than the threshold.

8. The foundry sand reserving system according to claim 1, wherein one reserving unit is provided as the at least one reserving unit, the foundry sand reserving system further includes a supply unit configured to supply the foundry sand to the foundry sand related device, and the control unit supplies the foundry sand to the foundry sand related device from the one reserving unit, and reduces the supply amount from the one reserving unit, and supplies the foundry sand from the supply unit to the foundry sand related device such that a total amount of the supply amount from the one reserving unit and the supply amount from the supply unit becomes a predetermined set amount in a case where it is determined that the reserve amount in the one reserving unit is smaller than the threshold.

9. The foundry sand reserving system according to claim 1, wherein a plurality of reserving units is provided as the at least one reserving unit, the foundry sand reserving system further includes a supply unit configured to supply the foundry sand to the foundry sand related device, and the control unit supplies the foundry sand from the plurality of reserving units to the foundry sand related device, and performs control such that a total amount of the supply amounts from the plurality of reserving units becomes a predetermined set amount while reducing the supply amount from the at least one reserving unit before the determination in a case where the reserve amount in the at least one reserving unit among the plurality of reserving units is smaller than the threshold and the reserve amount in another reserving unit among the plurality of reserving units is equal to or larger than the threshold.

10. A foundry sand reserving method utilizing the foundry sand reserving system according to claim 1, comprising:

reserving foundry sand capable of being supplied to the foundry sand related device in the at least one reserving unit;

acquiring a reserve amount of the foundry sand in the at least one reserving unit, a charge amount of the foundry sand to the at least one reserving unit, and a supply amount of the foundry sand to the foundry sand related device;

setting a threshold for the reserve amount based on a predetermined aging time of the foundry sand, and the charge amount and the supply amount acquired in the acquiring; and controlling at least one selected from the group consisting of the charge amount and the supply amount based on the reserve amount acquired in the acquiring and the threshold set in the setting.

11. The foundry sand reserving method according to claim 10, wherein the acquiring includes measuring the reserve amount by at least one selected from the group consisting of a microwave sensor, a millimeter wave sensor, and a sounding level gauge.

12. The foundry sand reserving method according to claim 10, wherein the reserving includes reserving the foundry sand in one reserving unit as the at least one reserving unit, and the controlling includes causing a first charging unit and a second charging unit to prepare the foundry sand capable of being charged to the one reserving unit, charging the foundry sand to the one reserving unit from the first charging unit, and charging the foundry sand to the one reserving unit from the second charging unit in a case where it is determined that the reserve amount in the one reserving unit is smaller than the threshold.

13. The foundry sand reserving method according to claim 10, wherein the reserving includes reserving the foundry sand in a plurality of reserving units as the at least one reserving unit, and the controlling includes causing a first charging unit to prepare the foundry sand capable of being charged to the plurality of reserving units, charging the foundry sand from the first charging unit to the plurality of reserving units, and charging the foundry sand from the first charging unit to the at least one reserving unit such that the charge amount is larger than the charge amount to the at least one reserving unit from the first charging unit before the determination in a case where it is determined that the reserve amount in at least one reserving unit among the plurality of reserving units is smaller than the threshold and the reserve amount in another reserving unit among the plurality of reserving units is equal to or larger than the threshold.

14. The foundry sand reserving method according to claim 10, wherein the reserving includes reserving the foundry sand in a plurality of reserving units as the at least one reserving unit, and the controlling includes causing a first charging unit and a second charging unit to prepare the foundry sand capable of being charged to the plurality of reserving units, charging the foundry sand to the plurality of reserving units from the first charging unit, and charging the foundry sand to at least one reserving unit among the plurality of reserving units from the second charging unit in a case where the reserve amounts in the plurality of reserving units are smaller than the threshold.

15. The foundry sand reserving method according to claim 14, wherein the controlling includes charging the foundry sand from the first charging unit to at least one reserving unit having a smaller reserve amount than in another reserving unit among the plurality of receiving units such that the charge amount is larger than the charge amount to the at least one reserving unit from the first charging unit before the determination.

16. The foundry sand reserving method according to claim 14, wherein the controlling includes charging the foundry sand from the second charging unit to at least one reserving unit having a smaller reserve amount than another reserving unit among the plurality of receiving units such that the charge amount is larger than the charge amount to the at least one reserving unit from the second charging unit before the determination.

17. The foundry sand reserving method according to claim 10, wherein the reserving includes reserving the foundry sand in one reserving unit as the at least one reserving unit, and the controlling includes causing a supply unit to prepare the foundry sand capable of being supplied to the foundry sand related device, supplying the foundry sand from the one reserving unit to the foundry sand related device, and reducing the supply amount from the one reserving unit and supplying the foundry sand from the supply unit to the foundry sand related device such that a total amount of the supply amount from the one reserving unit and the supply amount from the supply unit becomes a predetermined set amount in a case where it is determined that the reserve amount in the one reserving unit is smaller than the threshold.

18. The foundry sand reserving method according to claim 10, wherein the reserving includes reserving the foundry sand in a plurality of reserving units as the at least one reserving unit, and the controlling includes supplying the foundry sand to the foundry sand related device from the plurality of reserving units, and performing control such that a total amount of the supply amounts from the plurality of reserving units becomes a predetermined set amount while reducing the supply amount from the at least one reserving unit from the supply amount from the at least one reserving unit before the determination in a case where it is determined that the reserve amount in the at least one reserving unit among the plurality of reserving units is smaller than the threshold and the reserve amount in another reserving unit among the plurality of reserving units is equal to or larger than the threshold.

19. The foundry sand reserving method according to claim 10, wherein the reserving includes reserving the foundry sand in a plurality of reserving units as the at least one reserving unit, and the controlling includes causing a supply unit to prepare the foundry sand capable of being supplied to the foundry sand related device, supplying the foundry sand from the plurality of reserving units to the foundry sand related device, and supplying the foundry sand from the supply unit to the foundry sand related device in a case where it is determined that the reserve amounts in the plurality of reserving units are smaller than the threshold.

20. The foundry sand reserving method according to claim 19, wherein the controlling includes supplying the foundry sand to the foundry sand related device from the supply unit such that a total amount of the supply amounts from the plurality of reserving units and the supply amount from the supply unit becomes a predetermined set amount while reducing the supply amounts from the plurality of reserving units from the supply amounts from the plurality of reserving units before the determination.

* * * * *